US012172045B2

(12) United States Patent
Monti

(10) Patent No.: US 12,172,045 B2
(45) Date of Patent: Dec. 24, 2024

(54) PROTECTIVE ROWING DEVICE

(71) Applicant: Jonathan Monti, West Warwick, RI (US)

(72) Inventor: Jonathan Monti, West Warwick, RI (US)

( * ) Notice: Subject to any disclaimer, the term of this patent is extended or adjusted under 35 U.S.C. 154(b) by 302 days.

(21) Appl. No.: 17/821,628

(22) Filed: Aug. 23, 2022

(65) Prior Publication Data

US 2023/0050760 A1 Feb. 16, 2023

Related U.S. Application Data

(63) Continuation of application No. 17/207,302, filed on Mar. 19, 2021, now Pat. No. 11,497,957.

(60) Provisional application No. 62/991,942, filed on Mar. 19, 2020.

(51) Int. Cl.

| | |
|---|---|
| ***A63B 21/00*** | (2006.01) |
| ***A63B 22/00*** | (2006.01) |
| ***A63B 71/00*** | (2006.01) |

(52) U.S. Cl.

CPC ..... *A63B 21/4009* (2015.10); *A63B 22/0076* (2013.01); *A63B 71/0054* (2013.01); *A63B 2209/00* (2013.01); *A63B 2225/62* (2013.01)

(58) Field of Classification Search

CPC ..... A63B 21/4009; A63B 22/0076; A63B 71/0054; A63B 2209/00; A63B 2225/62; A63B 21/005; A63B 21/0084; A63B 21/0088; A63B 21/225; A63B 22/16; A63B 22/0605; A63B 2022/0035; A63B 2213/004; A63B 21/4017; A63B 22/0087; A63B 23/0211; A63B 23/0233; A63B 69/0059; A63B 2023/0411; A63B 2071/0072; A63B 2208/0238; A63B 23/1236; A63B 22/203; A63B 2022/0079; A63B 2208/0223

See application file for complete search history.

(56) References Cited

U.S. PATENT DOCUMENTS

| | | | | |
|---|---|---|---|---|
| 199,432 | A * | 1/1878 | Goldie | A63B 22/0076 482/114 |
| 3,902,717 | A * | 9/1975 | Kulkens | A63B 21/4047 482/130 |
| 5,110,118 | A * | 5/1992 | Winey | A63B 21/151 482/73 |
| 6,634,996 | B2 * | 10/2003 | Jacobsen | A63B 21/0628 482/142 |
| 6,726,608 | B1 * | 4/2004 | Hsu | A63B 23/03575 482/121 |

(Continued)

FOREIGN PATENT DOCUMENTS

WO WO-2021/188980 A1 9/2021

OTHER PUBLICATIONS

International Search Report and Written Opinion for International Application No. PCT/US21/23287 mailed Aug. 24, 2021.

(Continued)

*Primary Examiner* — Garrett K Atkinson

(74) *Attorney, Agent, or Firm* — Foley Hoag LLP; Erik A. Huestis; Joshua S. Matloff

(57) ABSTRACT

A protective rowing device for compression of the abdomen is provided that comprises a brace and U-shaped support member that may connect to a rowing machine seat and rail.

20 Claims, 52 Drawing Sheets

(56) References Cited

U.S. PATENT DOCUMENTS 6,923,749 B1 * 8/2005 Smith ..... A63B 21/0552 482/121
6,981,932 B1 * 1/2006 Huang ..... A63B 21/4035 482/121
6,991,589 B1 * 1/2006 Patterson ..... A63B 21/00069 482/142
7,226,400 B1 * 6/2007 Gedeon-Janvier ..... A63B 21/4031 482/106
7,785,232 B2 * 8/2010 Cole ..... A63B 23/0494 482/4
7,806,816 B2 * 10/2010 Erez ..... A63B 71/0009 482/148
7,946,964 B2 * 5/2011 Gothro ..... A63B 69/06 482/73
8,187,156 B2 * 5/2012 Hochberg ..... A63B 23/03541 280/304.2
8,192,332 B2 * 6/2012 Baker ..... A63B 69/06 482/133
8,469,866 B2 * 6/2013 Hochberg ..... A63B 21/0083 280/304.2
8,632,446 B2 * 1/2014 Solow ..... A63B 21/055 482/148
8,641,585 B2 * 2/2014 LaGree ..... A63B 22/203 482/92
8,764,617 B2 * 7/2014 Teeter ..... A61H 1/0292 482/126
9,586,081 B2 * 3/2017 Lagree ..... A63B 21/02
9,597,545 B1 * 3/2017 Lagree ..... A63B 22/0046
9,700,775 B2 * 7/2017 Hamilton ..... A63B 69/0002
10,639,520 B2 * 5/2020 Hou ..... A63B 21/0051
10,786,703 B1 * 9/2020 Zimmer ..... B63H 16/16
11,497,957 B2 11/2022 Monti
2002/0010060 A1 1/2002 Bray
2002/0055423 A1 * 5/2002 Casey ..... A63B 21/068 482/95
2002/0151419 A1 * 10/2002 Barnes ..... A63B 23/0211 482/142
2003/0153437 A1 * 8/2003 Tseng ..... A63B 23/03533 482/73
2005/0233868 A1 * 10/2005 Mills ..... A63B 22/0046 482/142
2007/0066462 A1 3/2007 Cohen
2007/0099774 A1 5/2007 Bruback
2007/0232973 A1 10/2007 Serola
2008/0224460 A1 * 9/2008 Erez ..... A63B 71/0009 280/801.1
2009/0017999 A1 * 1/2009 Halbridge ..... A63B 23/1209 482/130
2009/0203503 A1 * 8/2009 Gothro ..... A63B 69/06 482/72
2010/0164201 A1 * 7/2010 Hochberg ..... A63B 71/0009 482/139
2010/0279827 A1 * 11/2010 Farnsworth ..... A63B 21/4035 482/54
2011/0160626 A1 * 6/2011 Takahashi ..... A61H 1/0244 601/34
2011/0291449 A1 * 12/2011 Serlachius ..... A61F 5/02 297/230.11
2012/0196727 A1 * 8/2012 Larsson ..... A63B 69/06 482/72
2012/0283076 A1 * 11/2012 Hochberg ..... A61G 5/10 482/121
2013/0130876 A1 * 5/2013 Man ..... A63B 71/0054 482/142
2013/0150216 A1 6/2013 Bell et al.
2013/0203569 A1 * 8/2013 Athis ..... A63B 21/0428 482/142
2015/0057127 A1 * 2/2015 Lagree ..... A63B 21/00069 482/142
2016/0135547 A1 5/2016 Kuffrey et al.
2016/0317864 A1 11/2016 Sato
2016/0346155 A1 * 12/2016 Brown ..... A61H 1/0292
2017/0001064 A1 * 1/2017 Vorozilchak ..... A63B 21/4047
2017/0100625 A1 * 4/2017 Lagree ..... A63B 21/4035
2017/0100627 A1 4/2017 Monti
2017/0189740 A1 * 7/2017 Lagree ..... A63B 21/4035
2018/0093125 A1 * 4/2018 Johnson ..... A63B 22/20
2018/0169464 A1 * 6/2018 Janowski ..... A63B 21/4035
2019/0060699 A1 * 2/2019 Frederick ..... A63B 23/1281
2019/0099649 A1 * 4/2019 Machovina ..... A63B 69/06
2019/0168062 A1 6/2019 Monti
2019/0255377 A1 * 8/2019 Aronson ..... A63B 21/025
2020/0171344 A1 * 6/2020 Monti ..... A63B 21/4029
2021/0197014 A1 * 7/2021 Machovina ..... A63B 21/157
2021/0245003 A1 * 8/2021 Turner ..... A63B 21/023
2021/0291007 A1 9/2021 Monti
2022/0001234 A1 * 1/2022 Pirscher ..... A63B 22/0076
2023/0050760 A1 2/2023 Monti

OTHER PUBLICATIONS

Invitation to Pay Additional Fees for International Application No. PCT/US21/23287 mailed Jun. 17, 2021.

* cited by examiner

PROTECTIVE ROWING DEVICE

CROSS-REFERENCE TO RELATED APPLICATIONS

This application claims the benefit of priority to U.S. Application No. 62/991,942 filed Mar. 19, 2020, the entire contents of each are hereby incorporated by reference.

BRIEF SUMMARY

According to embodiments of the present disclosure, a exercise support device for compression of the abdomen is provided.

In an exemplary embodiment, the exerciser support device comprises: a U-shaped member, the U-shaped member comprising: a straight inferior region having two ends, the straight inferior region configured to be received in a seat slidably attached to a rowing machine rail, two upright portions, a first of the two upright portions connecting to a first end of the straight inferior region at a first angle, and a second of the two upright portions connecting to a second end of the straight inferior region at a second angle, and two superior attachment sites, a first of the two superior attachment sites connecting from a first of the two upright portions, a second of the two superior attachment sites connecting from a second of the two upright portions, each of the two superior attachment sites being configured to receive a brace; and a brace, the brace disposed parallel to the straight inferior region of the U-shaped member and attached to each of the two superior attachment sites, the brace comprising: an anterior side, the anterior side having a curvature configured to contact an exerciser's abdomen perpendicular to a spinal column of the exerciser and attaching to the superior attachment sites of the U-shaped member, and a posterior side, the posterior side having a curvature configured to contact an exerciser's back perpendicular to the spinal column of the exerciser and attaching to the superior attachment sites of the U-shaped member, wherein the posterior side is releasably attachable to the anterior side at at least one of the superior attachment sites by an attachment mechanism.

In some embodiments, the U-shaped support member rotates on an axis perpendicular to the rowing machine rail.

In some embodiments, the anterior side compresses on the exerciser's abdomen during exercise.

In some embodiments, the posterior side of the brace comprises a seat back.

In some embodiments, the posterior side of the brace comprises a roller.

In some embodiments, the rowing machine rail is affixed to a wedge.

In some embodiments, the attachment mechanism comprises a ratchet.

In some embodiments, the anterior side of the brace further comprises an air bladder.

In some embodiments, the air bladder compresses on the exerciser's abdomen during exercise.

In some embodiments, the brace is detachable from the U-shaped member.

In some embodiments, the brace is flexible.

In some embodiments, the brace is breathable.

In some embodiments, the brace comprises moisture wicking material.

In some embodiments, the brace comprises water-repellant material.

In some embodiments, the brace is size adjustable.

In some embodiments, the brace is adjustable.

In some embodiments, the brace comprises a stimulation component.

In some embodiments, the U-shaped member is configured to be received in a pillow block bearing of a rowing machine seat.

In some embodiments, the brace comprises detachable free weights.

In some embodiments, the attachment mechanism comprises a strap-in binding.

The present disclosure also includes a exerciser support device comprising: a J-shaped member, the J-shaped member comprising: an upright portion, an inferior attachment site, the inferior attachment site connecting from the upright portion to a seat slidably attached to a rowing machine rail, a superior attachment site, the superior attachment site connecting from the upright portion to a brace and configured to be received in the brace; and a brace, the brace disposed perpendicular to the upright portion of the J-shaped member and attached to the superior attachment site, the brace comprising: an anterior side, the anterior side having a curvature configured to contact an exerciser's abdomen perpendicular to a spinal column of the exerciser and attaching to the superior attachment site of the J-shaped member, and a posterior side, the posterior side having a curvature configured to contact an exerciser's back perpendicular to the spinal column of the exerciser and attaching to the superior attachment site of the J-shaped member, wherein the posterior side is releasably attachable to the anterior side by an attachment mechanism.

In some embodiments, the J-shaped support member rotates on an axis perpendicular to the rowing machine rail.

In some embodiments, the anterior side compresses on the exerciser's abdomen during exercise.

In some embodiments, the posterior side of the brace comprises a seat back.

In some embodiments, the posterior side of the brace comprises a roller.

In some embodiments, the rowing machine rail is affixed to a wedge.

In some embodiments, the attachment mechanism comprises a ratchet.

In some embodiments, the anterior side of the brace further comprises an air bladder.

In some embodiments, the air bladder compresses on the exerciser's abdomen during exercise.

In some embodiments, the brace is detachable from the J-shaped member.

In some embodiments, the brace is flexible.

In some embodiments, the brace is breathable.

In some embodiments, the brace comprises moisture wicking material.

In some embodiments, the brace comprises water-repellant material.

In some embodiments, the brace is size adjustable.

In some embodiments, the brace is adjustable.

In some embodiments, the brace comprises a stimulation component.

In some embodiments, the J-shaped member is configured to be received in a pillow block bearing of a rowing machine seat.

In some embodiments, the brace comprises detachable free weights.

In some embodiments, the attachment mechanism comprises a strap-in binding.

In another aspect, the present disclosure also includes a exerciser support device comprising: a linear member, the linear member comprising: an upright portion, the upright portion configured to be received in a bench, an inferior attachment site, the inferior attachment site connecting from the upright portion to the bench, a superior attachment site, the superior attachment site connecting from the upright portion to a brace and configured to be received in a brace; and a brace, the brace disposed perpendicular to the upright portion of the straight-shaped member and attached to the superior attachment site, the brace comprising: an anterior side, the anterior side having a curvature configured to contact an exerciser's abdomen perpendicular to a spinal column of the exerciser and attaching to the superior attachment site of the straight-shaped member, and a posterior side, the posterior side having a curvature configured to contact an exerciser's back perpendicular to the spinal column of the exerciser and attaching to the superior attachment site of the straight-shaped member, wherein the posterior side is releasably attachable to the anterior side by an attachment mechanism.

In some embodiments, the anterior side compresses on the exerciser's abdomen during exercise.

In some embodiments, the attachment mechanism comprises a ratchet.

In some embodiments, the anterior side of the brace further comprises an air bladder.

In some embodiments, the air bladder compresses on the exerciser's abdomen during exercise.

In some embodiments, the brace is detachable from the linear member.

In some embodiments, the brace is flexible.

In some embodiments, the brace is breathable.

In some embodiments, the brace comprises moisture wicking material.

In some embodiments, the brace comprises water-repellant material.

In some embodiments, the brace is size adjustable.

In some embodiments, the brace is adjustable.

In some embodiments the brace comprises a stimulation component.

In some embodiments, the linear member is configured to be received in a pillow block bearing of the bench.

In some embodiments, the brace comprises detachable free weights.

In some embodiments, the attachment mechanism comprises a strap-in binding.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the device of the disclosed subject matter. Together with the description, the drawings serve to explain the principles of the disclosed subject matter.

DETAILED DESCRIPTION

Figure 1:
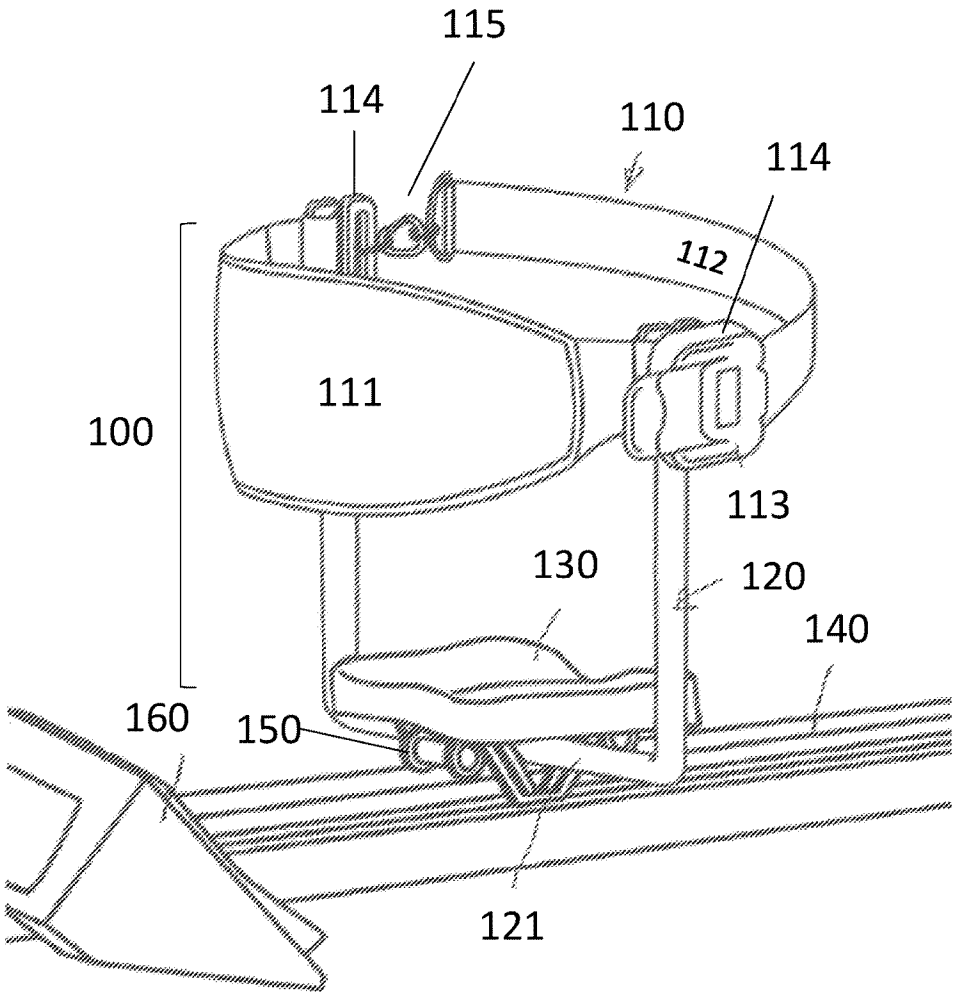
FIG. 1 is a front perspective view of a brace attached to a U-shaped support member of a rowing machine according to embodiments of the present disclosure.

Tight abdominal muscles and correct posture are two important components for improving and efficiently performing certain exercises (e.g., rowing), reducing back pain, and for withstanding abdominal impacts. Improved posture during exercise is often associated with a tight abdominal area and is, as stated above, an important component in preventing medical conditions, or worse, injury to the exerciser. Accordingly, poor posture during exercise may lead to a protruding abdomen and result in abdominal weakness which in some cases can lead to a condition called diastasis recti.

Diastasis recti can be defined as a gap between the two sides of the rectus abdominis muscle, resulting in a protruded abdominal area. Newborn babies may be born with diastasis recti, especially if they are premature. Diastasis recti may appear as a ridge running down the midline of the abdomen, anywhere from the xiphoid process to the umbilicus. The gap may become more prominent with straining during exercise, but can disappear when the abdominal muscles become relaxed. The act of rowing (e.g., rowing on a rowing machine, rowing on a row boat) may place stress on a rower's abdomen, especially if the rower strains the abdominal area by pushing with the legs. Poor posture can also contribute to stress on the abdomen. For this reason, it is important for the rower to sustain tightness of the abdominal muscles and maintain proper form to protect the abdominal region from development of said conditions or injuries.

The present disclosure provides for rowing devices that create compression and provide means for enhancing the posture of a rower. In some embodiments, the rowing device includes an abdominal brace attached to a U-shaped support member that allows the rower to move his or her torso freely with said compressive protection and postural enhancement during the performance of the exercise on a machine on land or in a boat on water. In some embodiments, the allowed direction of motion is primarily a lateral sway (left/right), with motion in the forward/backwards (anterior/posterior) direction inhibited or prohibited. It will be appreciated that limiting the range of motion of the torso can promote compression of the abdomen and proper back posture when wearing the brace, and can lead to greater protection of the abdomen. The limited range of motion of the torso in the brace also allows the rower to leverage more force in the pulling movement of a rowing machine cord or a row boat oar. In some embodiments, the rowing device includes a vertically extending support member comprising one or two lateral supports. The vertically extending support member contacts the dorsal end of the exerciser. Non-limiting examples of the vertically extending support member include a chair back or a T-shaped member (e.g., padded T-shaped member).

As used herein, the term "U-shaped member" refers to a member having the shape of a capital letter U or a member having two ends, bent such that terminal lengths of the member at each end are parallel to each other. Similarly, the term "J-shaped member" refers to a member having the shape of a capital letter J or a member having two ends, bent such that terminal lengths of the member at each end are perpendicular to each other.

The present disclosure sets out various aspects of exemplary protective rowing devices. In various embodiments, a brace is adapted to be fitted to the rower's abdomen and is attachable to a U-shaped support member. The U-shaped support member can be attached to the rowing seat from below the seat and/or to the sides of the seat. In some embodiments, the rowing U-shaped support member attached to the rowing seat moves frontward and rearward along the rowing machine rail. A protective rowing device is simple to use and adjust, and can accommodate any torso size of a rower. Advantages of the device include simplicity, adjustability, and limited range of motion, thereby facilitating compression of the abdomen by the brace. Devices as set out here are particularly suitable for use where the rower is preventing conditions or injury to the abdomen or recovering from a particular conditions or injury to the abdomen e.g., diastasis recti or hernia. The design can result in low manufacturing costs. In accordance to the ease of use of the device, the device does not require careful adjustment by a trained fitness trainer or physical therapist, whose services may be expensive to obtain.

In the present disclosure, some features of the device are discussed for one side of the brace (e.g., anterior side or posterior side). As used herein, the terms anterior and posterior are used relative to a user of the device. Accordingly, the anterior side of a device is the side disposed on the front of a user (e.g., across the abdomen) while the posterior side of a device is the side disposed on the back of a user (e.g., across the back).

With reference now to FIG. 1, a brace attached to an upward support member (e.g., U-shaped support member) of a rowing machine, viewed from the front, is shown according to embodiments of the present disclosure. The protective rowing device 100 comprises a brace 110 that attaches to an upward support member (e.g., U-shaped support member) 120 that may be shaped like a U or take on a structure that more resembles a traditional seat back, a centralized vertical structure attached to a horizontal padded structure, such as a J-shaped member attached to a seat back, or modifications thereof. Said modifications may allow for a spring-like action as seen on many office chairs. Said spring-like action may be allowed by a freely moving pivot or hinge. In a one embodiment, free movement is that most commonly practiced with said U-shaped member. The protective rowing device attaches to the rowing machine seat assembly 130 which is slidably attached to the rail 140 of the rowing machine. In the instant embodiment an anterior side 111 of the brace 110 and the posterior side 112 of the brace 110 are connected to each other at each end of the upward support member 120, which are disposed on the sides of the exerciser when in use. The anterior side 111 has a curvature configured to contact the exerciser's abdomen and attaches to superior attachment sites 114 of the upward support member 120 (e.g., U-shaped support member). The posterior side 112 is a belt that is pulled out of a ratcheting, hook-and-pile or hook-and-loop, seat belt, or strap-in binding (e.g., snow board binding) member 113, which contacts the exerciser's back and attaches to the superior attachment sites 114 of the upward supporting member (e.g., U-shaped support member) 120.

The inferior portion or pillow block bearing 121 of the upward support member 120 (e.g., U-shaped support member) is attached to the support structure of the rowing machine seat 130 by pillow block bearings. The seat 130 slides frontward and rearward along the rowing machine rail 140. On one end, the rail is attached to the anterior region of the machine at the foot rest (e.g., wedge) 160 at one end, and the posterior area of the machine. One the other end, the rail is attached to the posterior region of the machine (e.g., concave rocker).

While a support member 120 is depicted in FIG. 1 as a U shape with right angle corners, it will be appreciated that alternative shapes may be adopted. In general, suitable support shapes are those that accommodate a user's hips between two upright portions. In this embodiment, the two upright portions are continuous with the inferior portion, which extends beneath the user. It will be appreciated that in alternative embodiments, the U-shaped support member may comprise several joined sections. In some embodiments, in place of right angle corners, the upright portions form a gradual curve descending to meet the pillow block bearing 121 of the U-shaped member 120. In some embodiments, the straight inferior region 121 of the U-shaped member 120 has a round cross-section.

In other embodiments, discussed further below, a J-shaped member is used in place of the U-shaped member. In such embodiments, one of the anterior side 111 or the posterior side 112 is attached to the single upright of the J-shaped member. For example, in some embodiments, the J-shaped member supports the posterior side 112, which in some embodiments is a chair back or T shape.

The anterior side 111 of the brace 110 may be worn such that a lower edge is disposed below the top of the pelvis and an upper edge is disposed on or near the lower chest.

A variety of attachment and compression mechanisms can be used to coordinate the anterior side 111 and the posterior side 112 of the brace. In some embodiments, the attachment mechanisms comprise use of ratchets. In some embodiments, the ratchets comprise of a housing and belt with a clasp on the end. In other embodiments, the attachment mechanisms comprise use of a nut and bolt, rivets, sewing or chemical fastening (e.g. adhesives) for ends that form origination points of said attachment mechanisms. Adjustment-straps may be used and include a hook-and-loop fastener to provide adjustability in relation to the brace. Some embodiments also include adjustment-straps that may be removable and replaceable. Additionally, adjustment-straps may include button fasteners to provide adjustability. In the embodiment illustrated in FIG. 1, the attachment mechanism comprises a ratchet 113. In some embodiments, gussets are placed on the support member to prevent the support member from collapsing when pressure is created from the ratchet. In some embodiments a hook-and-pile or hook-and-loop feature 115 is used. It will be appreciated that a variety of attachment methods may be used to allow a user to attach and detach brace 110. While the embodiment depicted in FIG. 1 is deployed on a stationary rowing machine, it will be appreciated that devices according to the present disclosure may instead be deployed on a rowboat or crew skull. In such deployments, rapid detachment allows for a rower to safely free themselves in the event that the boat or skull capsizes or takes on water. Said detachment may be seen on FIG. 1 as the loops that are vertically oriented and attached to the fronts of the superior attachment sites 114. Said loops are held onto the superior attachment sites 114 by a notched shape. In the event of rapid detachment, the user can easily lift off the anterior portion 111 of the brace 110 and free himself or herself even without relinquishing the tension of the ratchet and belt system 113.

In some embodiments, anterior side 111 and/or posterior side 112 may include one or more air bladders. Such air bladders allow for expansion of anterior side 111 and/or posterior side 112 in order to provide compression. In some embodiments, a ratchet or eccentric shape is provided within anterior side 111 and/or posterior side 112 in order to create compression by expanding anterior side 111 and/or posterior side 112.

In some embodiments, the posterior side 112 of the brace 110 is fabricated from flexible material such as woven plastic or fabric (e.g., as might be used in the seat of a beach chair), or an inflexible material such as solid plastic (e.g., as might be used in the seat of an office chair).

In another embodiment, the posterior area of the brace 110 may resemble a configuration comprising a guide arm that creates a pivoted fulcrum. The pivoted fulcrum creates lateral to vertical movement or vertical to lateral movement. At the superior end of said guide arm an articulating pad or roller will be affixed. A resistance or guiding mechanism will be employed in said lateral to vertical movement or vertical to lateral movement. In some embodiments, the resistance or guiding mechanism will be configured to assist during the recovery phase of the exercise.

Wearing brace 110 during sit-up type exercise creates enormous amounts of heat. This may be advantageous in weight loss, causing large amounts of sweat to be produced during exercise. However, in some scenarios, excessive sweating may be undesirable. Accordingly, in some embodiments, apertures are provided in the anterior and/or posterior areas of brace 110. In some embodiments, the anterior and/or posterior areas of brace 110 are constructed of thin breathable material. In some embodiments the anterior and/or posterior areas of brace 110 are constructed out of foam material to improve comfort during use. The anterior surface of the brace may include a moisture wicking material. In some embodiments, the anterior and/or posterior areas of brace 110 may include neoprene (or other suitable material) for comfort. In some embodiments, brace 110 is constructed from a semi-rigid-plastic material (e.g., polycarbonate, etc.). A polycarbonate material may be 3/16" in thickness, or another suitable thickness to provide the desired flexibility and rigidity. In some embodiments, the anterior side 111 and/or posterior side 112 of the brace 110 include rubber. Additional embodiments may include other materials, dependent upon user preferences and manufacturability. In some embodiments, the anterior side 111 and/or posterior side 112 of the brace 110 include a removable and washable cover. In some embodiments, brace 110 is constructed from water-repellent materials. In some embodiments, brace 110 comprises a water sensor and releases tension once water is detected.

In addition to stationary rowing device and boats, support devices as set out herein may be deployed on bicycles. In such exemplary deployments, the upward supporting member (e.g., U-shaped support member) may be telescopic to allow the cyclist to change positions by standing in the saddle. In some embodiments, the support member attached to a bicycle may lean obliquely (also known as fishtailing).

In some embodiments, the brace 110 is size adjustable to accommodate a range of sizes for the exerciser. Embodiments of the protective abdominal exercise system may be available in multiple overall sizes to accommodate different abdominal sizes. In some embodiments, the width of the brace is based on the standard clothing torso size of the exerciser (e.g., small, medium, large, or extra-large). In some embodiments, the width of the brace is such that it does not obstruct or hinder the exerciser during use.

In some embodiments, the brace 110 comprises a stimulation component in the anterior side 111, posterior side 112, or both side components of the brace. The stimulation component may be selectively controlled to provide an electronically controlled stimulus signal for stimulating the area of the abdomen and/or back under the brace. Exemplary stimulation components include, but are not limited to, Transcutaneous Electrical Nerve Stimulation (TENS), heat stimulation, massage stimulation, or any combination thereof. In some embodiments, the stimulation component may be used to provide bio feedback to the exerciser. Examples of stimulation component in exercise belts are disclosed in U.S. Publication No. 2007/0066462 and U.S. Publication No. 2019/0308065, the entire contents of which are hereby incorporated by reference.

In some embodiments of the brace, anterior side 111 and/or posterior side 112 contain a knobby surface texture that massage the intended area during performance of the movement on the machine.

A variety of materials can be used for fabricating the upward support member (e.g., U-shaped support member) 120. Examples of materials used for the upward support member (e.g., U-shaped support member) 120 include, but are not limited to, metal, plastic, rubber or composites such as reinforced plastic. Materials can be formed via a variety of processes, e.g., 3D printing, injection molding, or urethane casting. In some embodiments, upward support member (e.g., U-shaped support member) 120 is constructed from flame-retardant materials. In some embodiments, the upward support member (e.g., U-shaped support member) 120 is constructed from water-repellant materials. In some embodiments, the upward support member (e.g., U-shaped support member) 120 is constructed from anti-fungal materials. In some embodiments, the upward support member (e.g., U-shaped support member) 120 is fabricated from aluminum. In some embodiments, the upward support member (e.g., U-shaped support member) 120 is fabricated from carbon fiber. Generally, suitable materials include those that are strong enough to sustain the weight of the user and the stresses of daily use (e.g., resistant to temperature and weather changes).

The two superior ends 114 have a tendency to move toward one another when compression is applied in the assembly via a ratchet 113. In some embodiments, this may be mitigated by providing a rigid seat back type posterior portion 112. In some embodiments, the seat back is a non-bendable structure such as a formed piece of metal that is attached between the two uprights of the upward support member (e.g., U-shaped support member) 120. Such a metal structure may be covered by padding materials.

In some embodiments, the width of the upward support member (e.g., U-shaped support member) 120, is appropriate to allow all structures to be in place and perform their intended action without obstructing or hindering a rower's elbows as the rower performs the phases of the rowing exercise. In some embodiments, the height of the upward support member 120 (e.g., U-shaped support member) is adjustable, such as by telescoping, especially when affixed on a bicycle seat. In some embodiments, the width of the upward support member 120 (e.g., U-shaped support member) is adjustable.

It will be appreciated that a variety of mechanical joints can be used to connect the upward support member 120 (e.g., U-shaped support member) to the rowing machine seat assembly 130. For example, the pillow block bearing of the upward support member 120 (e.g., U-shaped support member) and the rowing machine seat assembly 130 can be connected by a hinge, knuckle joint, pin joint, or a ball and socket joint adapted to allow for rotation of the upward support member 120 about an axis perpendicular to the rail 140. In some embodiments, the use of a guide arm and pivot fulcrum create lateral to vertical movement or vertical to lateral movement may be employed. In some embodiments, use of a guide arm, trolley, and curved rail assembly create lateral to vertical movement or vertical to lateral movement. In some embodiments, the joints used to attach the upward support member (e.g., U-shaped support member) 120 and the rowing machine seat assembly 130 are incorporated into the upward support 120. In some embodiments, the upward support member 120 (e.g., U-shaped support member) is attached to the rowing machine seat assembly 130 by a pillow block bearing. The pillow block is affixed to the bottom of the seat. In some embodiments, a metal plate is affixed between the bottom of the seat and the rollers that engage with the rack. The pillow blocks may be affixed to the metal plate.

In an exemplary embodiment, the protective rowing device may be arranged as a kit. In particular, protective rowing device may further include a set of instructions. Instructions may detail functional relationships in relation to the structure of the protective rowing device such that the protective rowing device can be assembled, used, maintained, or the like, in a preferred manner. In some embodiments, the kit is made for adapting an existing rowing machine to include the upward support member 120 (e.g., U-shaped support member).

On most rowing machines the seat assembly slides off the back by removing several stops. These stops may be, for example, vertically-oriented bolts. A seat assembly including an upward supporting member, brace, and associated parts may be provided in a kit that is adapted for installation on a particular manufacturer of rowing machines. In some embodiments, the kit comprises a pillow block bearing that is adapted to attach to the underside of a seat of a rowing machine and to slide onto the rail of rowing machine. In some embodiments, the upward support may be disassembled to attach and detach from the pillow block bearing, while the pillow block bearing stays affixed in the seat structure between the pillow block bearings. Such disassembly may be achieved through joints comprising ball detents and/or screw locks.

Figure 2:
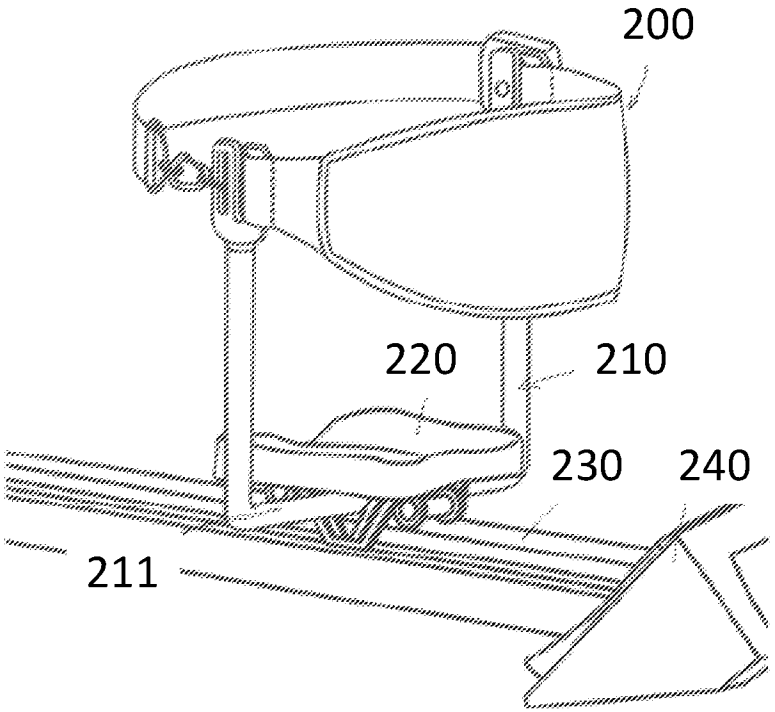
FIG. 2 is an alternate front perspective view of a brace attached to a U-shaped support member of a rowing machine according to embodiments of the present disclosure.

Referring now to FIG. 2, an alternative front view of the protective rowing device of FIG. 1 is provided. The protective rowing device 200 attaches to rowing machine seat 220 and rail 230 via attachment by the U-shaped support member 210. The U-shaped support member 210 rotates on an axis perpendicular to rail 230. The rotational axis of the U-shaped support member is along the straight inferior region 211 of the support member. In particular, in embodiments where the straight inferior region has a circular cross-section, the axis of rotation extends through the center of the circular cross-section at the midpoint of the inferior region. This allows for relative motion of the seat 220, U-shaped member 210, and brace 200 during rowing. The foot rest of the rowing machine 240 is shown in greater detail in FIG. 3.

Figure 3:
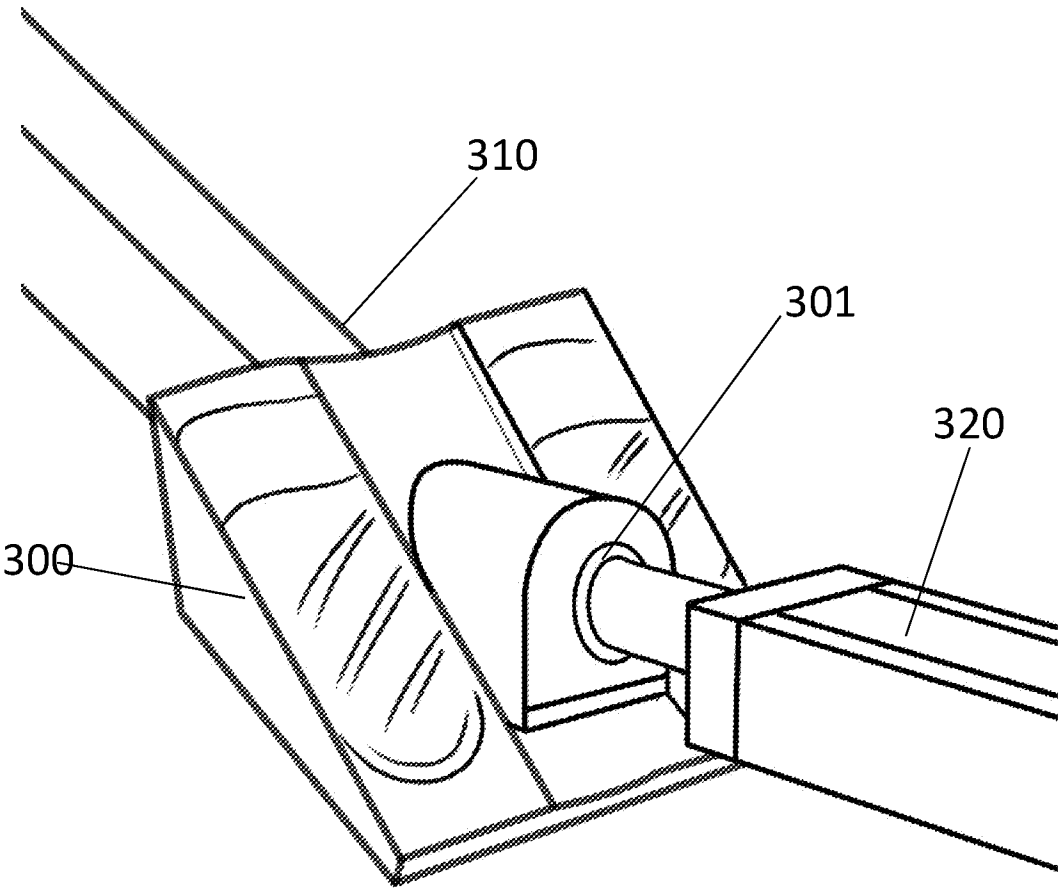
FIG. 3 shows a foot rest of a rowing machine according to embodiments of the present disclosure. The figure illustrates the exerciser tilting on the machine with a uniaxial rotation from lateral left to lateral right.
Figure 4:
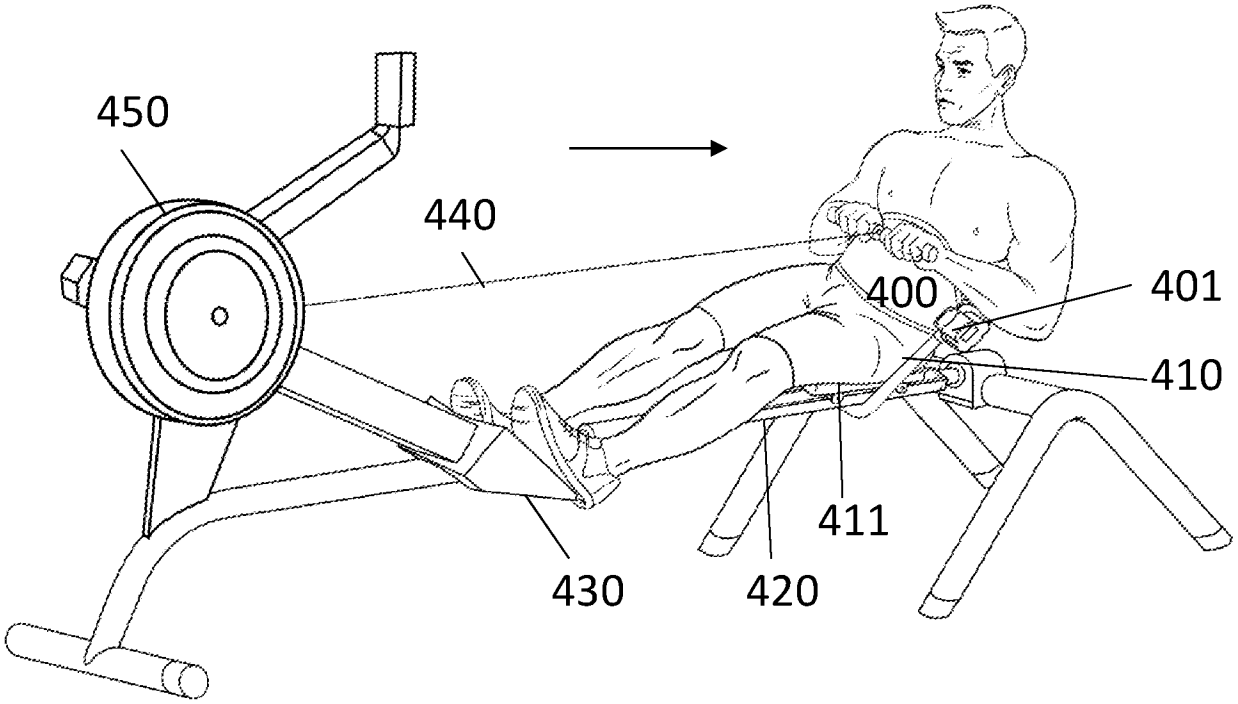
FIG. 4 is a front view of a protective rowing device in use by a rower according to embodiments of the present disclosure.

With reference to FIG. 3, detail of a foot rest 160 is provided. A wedge 300 is connected to rail 320 and to an anterior support arm 310. In a rowing machine, arm 310 connects to a resistive element such as a flywheel, a variable air resistance component, a magnetic resistance component, or a water resistance component (as shown in FIG. 4). Wedge 300 is connected to rail 320 via a uniaxial rotating coupling 301. In some embodiments, the rotating coupling is a multi-axial ball joint. The rail (or rack) rotates about coupling 301, allowing the attached seat and rail assembly to uni-axially tilt to the left or to the right.

With reference to FIG. 4, a front perspective view is provided of a protective rowing device adapted for uni-axial tilting in use by a rower. Rail 420 of the rowing machine is adapted to rotate at a coupling attached to wedge 430 in an area near to the rower's feet (as shown in further detail in FIG. 3) and a coupling at the opposite end of the rail 420, allowing the seat and the rower to tilt. The rower wears and secures the brace 400 around the abdomen by fastening the brace with a fastening closure, whether a ratchet housing (e.g., 401), hook-and-pile or hook-and-loop assembly, seat belt, strap-in binding (e.g., snowboard binding), or other compression device such as an air bladder. The brace attaches to a U-shaped support member 410, which is rotatable and attached to the seat assembly 411.

The first phase of the rowing movement is the catch in which the user's legs are completely bent with feet positioned on wedge 430 while resting on and engaging the seat 411. In the next phase, the drive is performed, in which the user pulls the rowing machine cord 440. Pushing with the legs is coordinated with pulling with the arms and back. As the pulling and the pushing happens, the seat assembly 411 slides backwards on the rail 420, and the rowing machine cord 440 is pulled from resistive element 450. The next phase of the rowing movement is the finish, in which the rower's legs are completely extended, and the back and arm muscles have pulled the rowing machine handle to the chest or abdomen and the elbows are extended back behind the body. In some embodiments, the rack is uni-axially or multi-axially tilted during the finish phase of the rowing stroke.

The last phase, the recovery, is the opposite of the drive. In the recovery phase, the arms and the legs relinquish the pull and flow back to the beginning of the stroke. The rowing movement returns back to the first phase, the catch. There is no resistance from the machine in the catch.

Figure 5A:
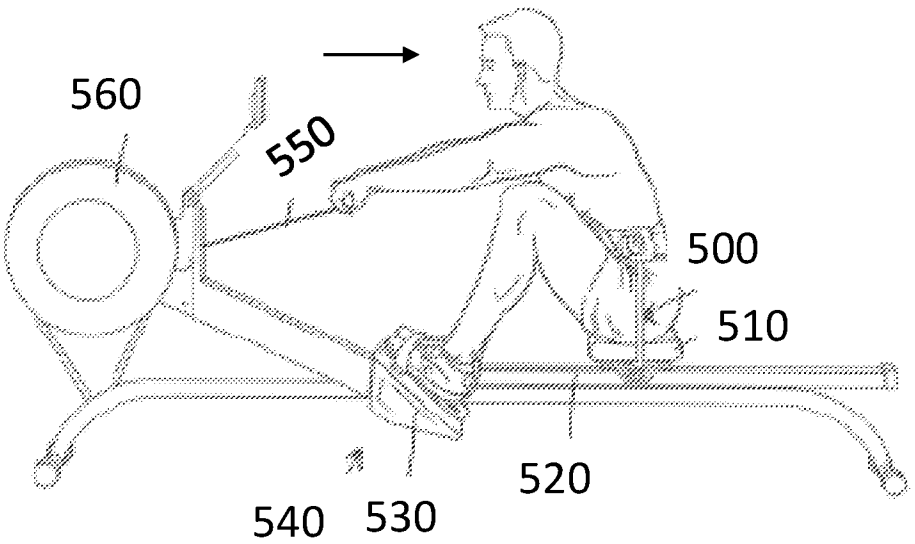
FIGS. 5A-B are side views of a protective rowing device in use by a rower according to embodiments of the present disclosure.
Figure 5B:
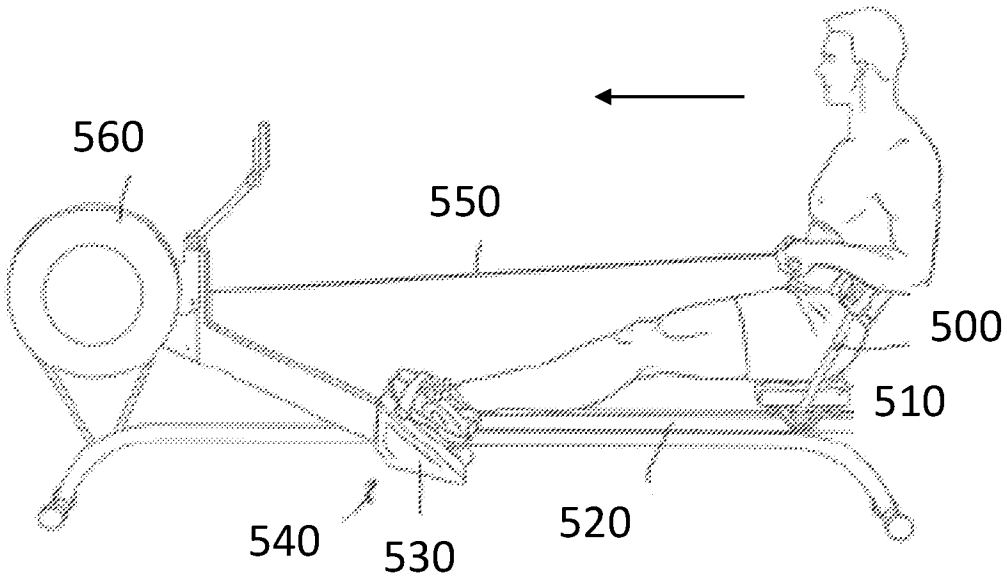

Referring now to FIGS. 5A-B, side views are provided of the protective rowing device in use by a rower on a rowing machine 540. The rower wears a brace that attaches to the upward supporting structure, such as the U-shaped support member 500, which is pivotally attached under the seat 510 and slides along the rowing rail 520. The seat and the brace together form a component that is slidably connected to the rack and fit about the exerciser. The exerciser sits on the seat 510 and secures the brace by placing it in the correct area and creating compression. Following this, the user moves to the front of the machine, secures their feet on wedge 530. The exercise commences with legs bent, back straight, and arms in a natural position holding onto the handle of the cord 550, which extends from resistive element 560. In this position, the rower is in the first phase of the exercise, the catch. The drive phase is performed by applying force initially through the legs and then through the arms and back. In both the catch and the drive, the compression of the brace promotes upward posture of the rower's torso as well as providing cues and force to hold and pull the abdominal muscles upward and inward. In general terms, the pushing of the legs in the drive can cause the exerciser to distend the abdomen. This may become apparent as an exerciser becomes fatigued or if they do not have the proper fitness to perform the exercise.

The next phase is the finish, in which the exerciser has their legs and back extended with the rowing handle at the abdomen or chest and elbows behind their body. The brace protects from distention in this phase as well. Lastly, the exerciser performs the recovery while the brace still promotes upward and correct posture with the abdomen being pulled upward and inward as the exerciser returns for the next stroke.

In embodiments of the present disclosure, the proper angle of the protective rowing device with respect to rowing machine rail is maintained throughout the allowed range of pivoting motion. It will be appreciated that a variety of angles are possible for the protective rowing device, and can be chosen based on the needs of rower during exercise. In some embodiments, the protective rowing device pivots to only one lateral end of the rail. In some embodiments, the protective rowing device pivots to both lateral ends of the rail. Limited range of motion may be used, for example, for rehabilitation purposes.

Figure 6:
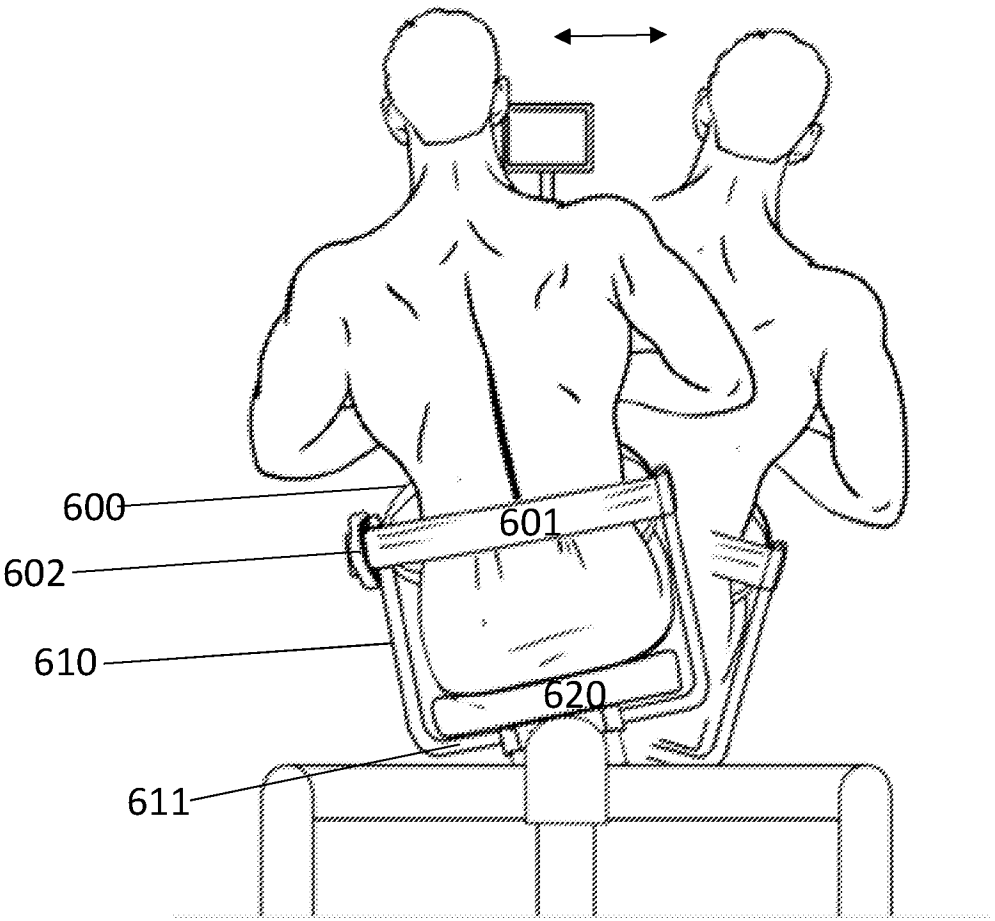
FIG. 6 is a back view of a protective rowing device in use by a rower according to embodiments of the present disclosure.

With reference to FIG. 6, a back view is provided of the protective rowing device adapted for uni-axial tilting in use by the rower. The rower wears the brace, which comprises a posterior side 601 and an anterior side 600. The brace is fastened about the abdomen of the rower with a fastening closure 602. In some embodiments, the brace is fastened on one side of the abdomen. The brace attaches to a U-shaped support member 610, which is pivotally attached to the seat assembly 620. The seat assembly and brace move forward and rearward on the rail in conjunction with the exerciser. As the exerciser performs the leaning drive phase, he or she leans to one side or the other and pulls the handle toward himself or herself in the finish. As the exerciser assumes this tilted or leaning finishing position, the musculature of the lower latissimus and obliques are highly engaged. Said latissimus and oblique musculature are much more highly activated than if the exerciser were not to lean. As this activity is carried out, the upward support of the brace becomes more significant as it supports the exerciser from potentially falling off to the side of the seat and or machine. In some embodiments, as the exercise is performed with the compression of the brace, a highly concentrated contraction in said musculature can be employed. Once at the finish, the exerciser leans back toward the middle and performs the recovery, from which the next stroke is begun. In some embodiments, the rower may return to the same side for a number of strokes, and may alternate from side to side, or may try to maintain a straight stroke. In some embodiments, the exerciser may balance and resist the tendency to lean to one side or the other.

Figure 7A:
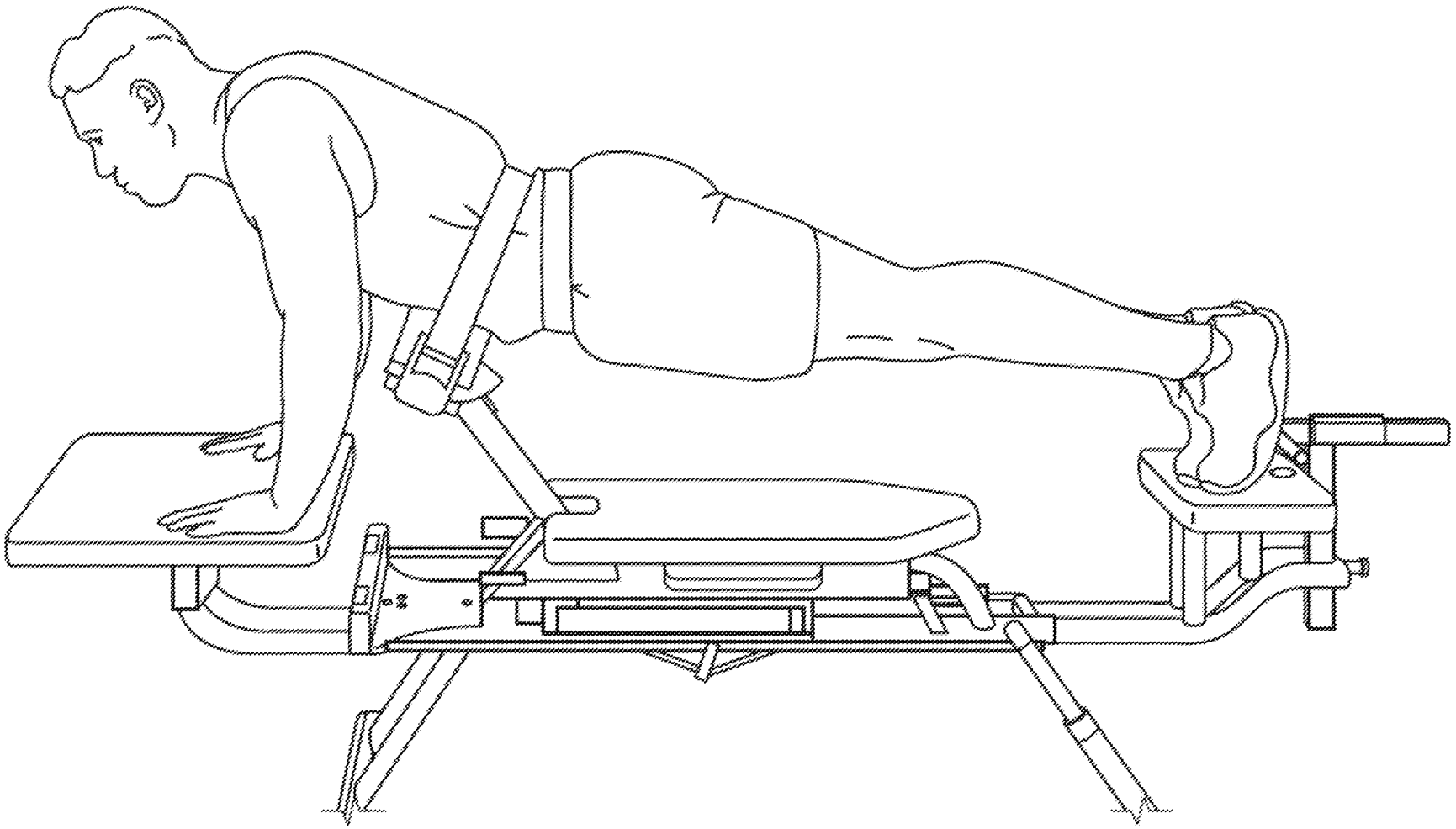
FIGS. 7A-B shows the use of a brace according to embodiments of the present disclosure during a plank hold (FIG. 7A) and a push up exercise (FIG. 7B).
Figure 7A:
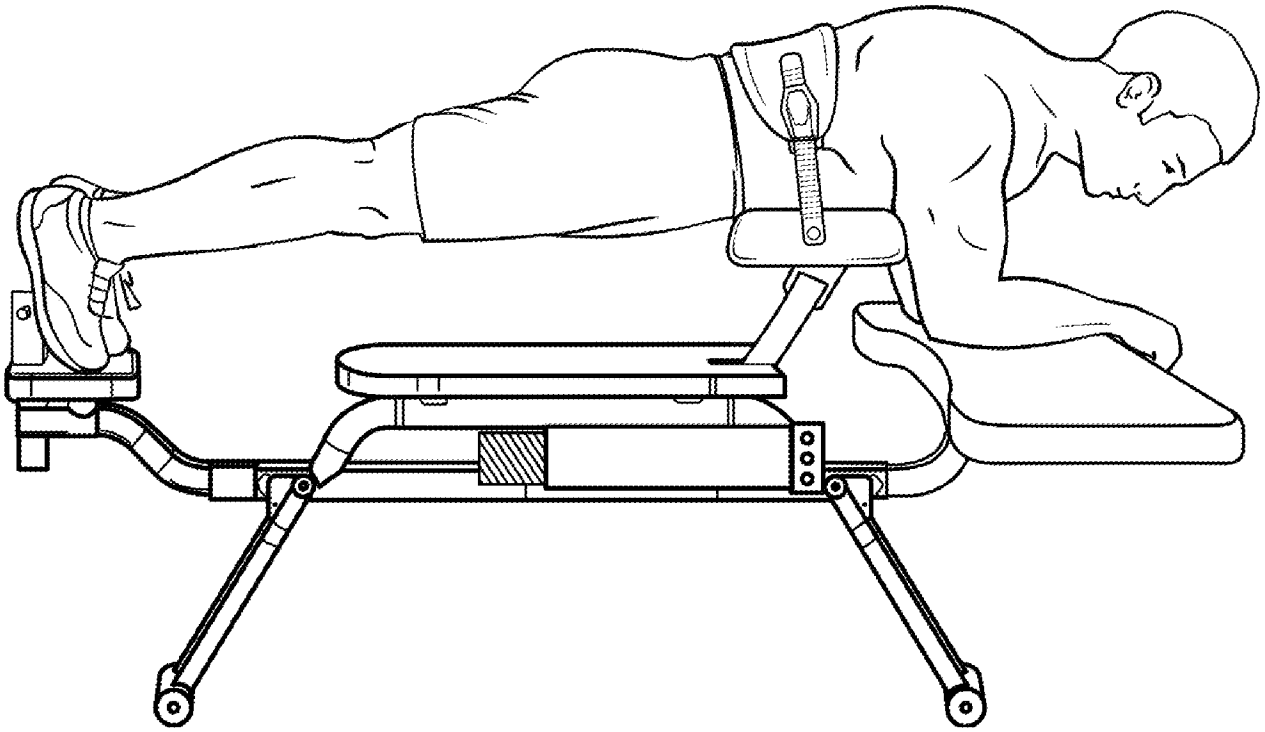
Figure 7B:
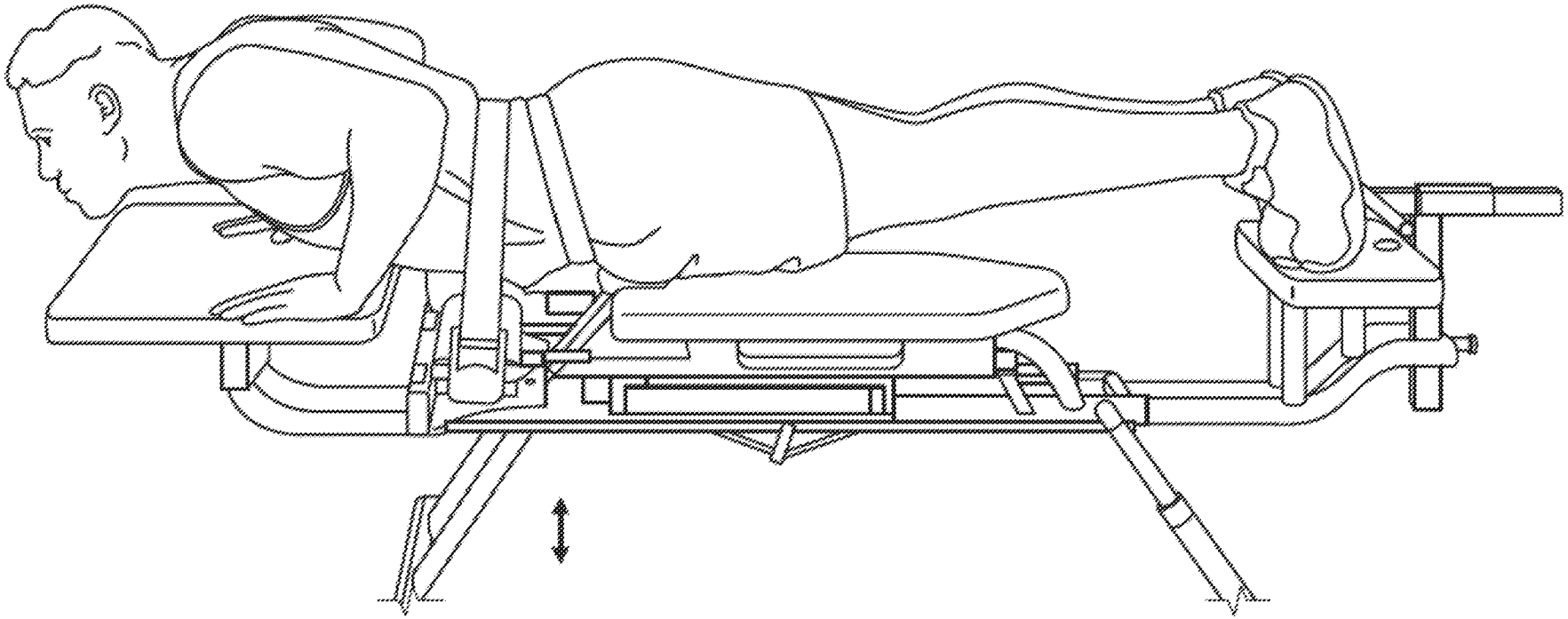
Figure 7B:
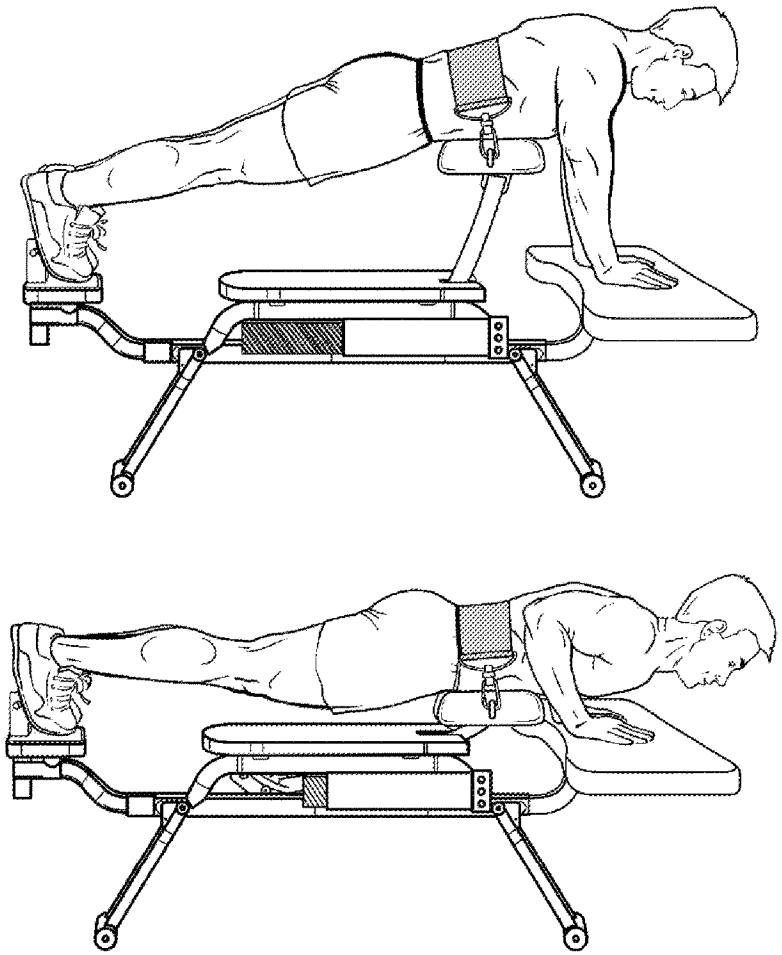

Referring now to FIGS. 7A-B, the drawing depicts an alternative use of braces according to the present disclosure. As in the rowing devices described above, the brace comprises an anterior side and a posterior side, which fasten together by a closure. In this example, the brace is worn on the abdomen of an exerciser in the absence of the U-shaped support member. The brace is attached to a guide of an exercise machine, such as a squatting machine, a back extension machine, a push-up machine, or a plank machine. Further details of exemplary machines may be found in US 2020/0171344, hereby incorporated by reference it its entirety. In some embodiments the brace may be worn on the abdomen of an exerciser during body weight-bearing exercises. Examples of body weight-bearing exercises include, but are not limited to, plank hold and push up exercises. FIG. 7A shows use of the brace during a plank hold. FIG. 7B shows use of the brace during a push up exercise. Stabilization of the exerciser's abdomen during plank hold or push up exercise creates compression to the exerciser's abdomen. Compression of the exerciser's abdomen encourages the exerciser to pull the abdomen muscles upward and inward during performance of the exercise, leading to proper form and posture maintenance during exercise performance.

Figure 8:
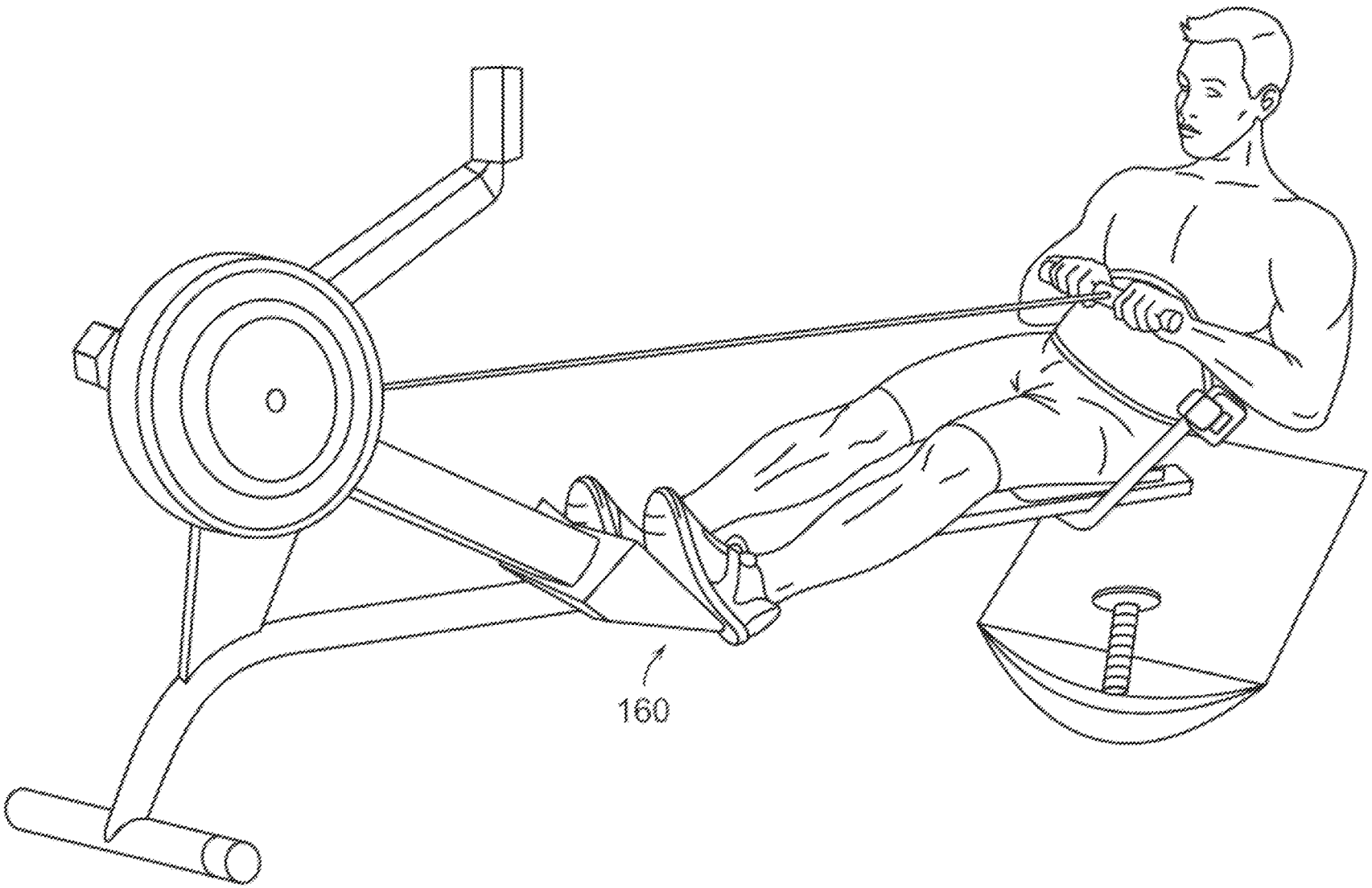
FIG. 8 is a front view of an alternative protective rowing device in use by a rower according to embodiments of the present disclosure. The figure illustrates the exerciser tilting on the machine with multiaxial rotation from lateral left to lateral right. The multiaxial rotation is created by a rocking structure, such as a concave rocker, that is placed underneath the exerciser.
Figure 8:
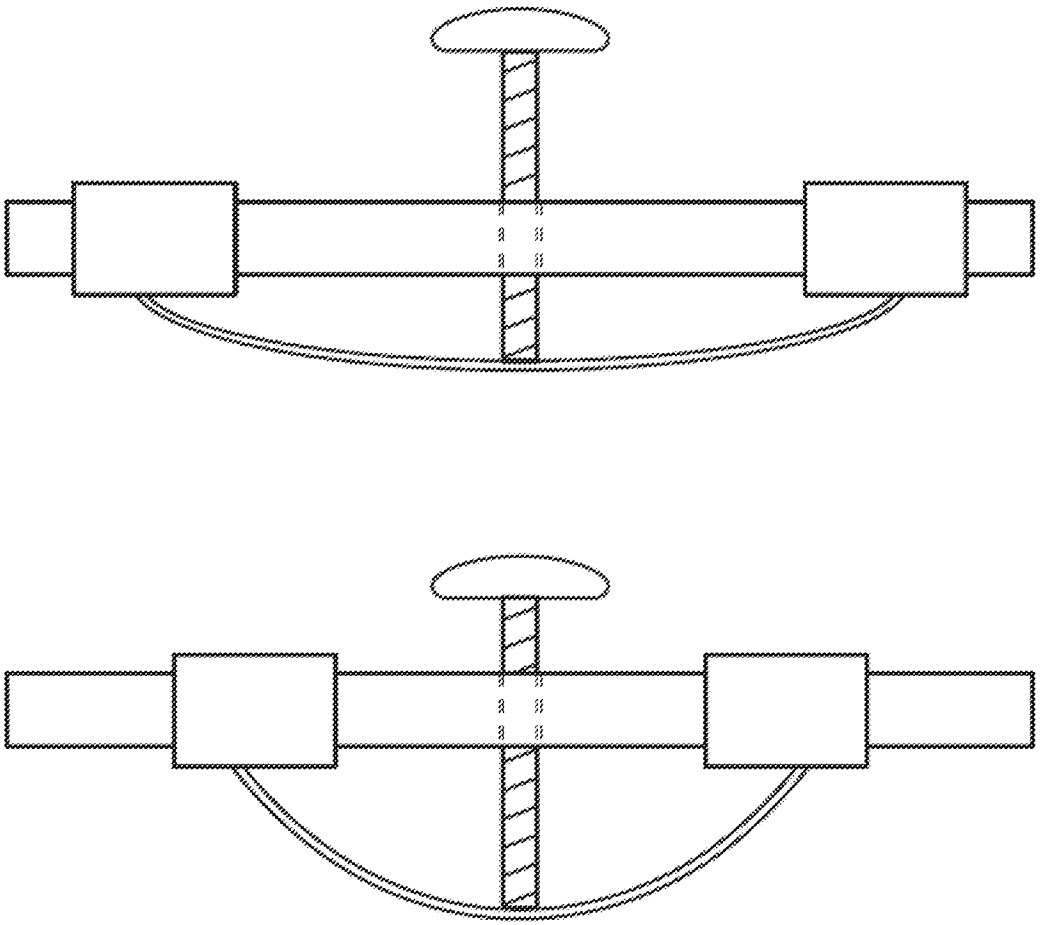

Referring now to FIG. 8, a front view is provided of an alternative protective rowing device that is adapted for multi-axial tilting in use by the rower. In some embodiments, the rack could tilt about a pivot between the seat and under the exerciser in the finish phase of the rowing stroke. In some embodiments, the area under the exerciser is fixed to a member that rocks (e.g., rocks similar to a cradle). In some embodiments, the rocking member tilts on the rack at varying degrees (e.g., 20 degrees or 160 degrees). In some embodiments, the rocking member is concave. The titling can be varied by changing the depression of the concave element (e.g., concave rocker) contacting the floor with a crank or screw.

The titling of the seat can take several forms and includes but is not limited to a solid structure, such as a concave rocker, that is located at the posterior region of the machine. The posterior of the machine is affixed with a variably concave structure, such as a concave rocker, that contacts the floor surface. The concave structure is variable to allow for the tilting of seat attached to the rack. The seat tilting may be changed by using a crank or screw to affect the depression of the concave rocker and therefore variably affect said tilt. The anterior of the concave rocker and rack will be between or near the feet and may comprise a ball joint or a structure similar thereto. Perhaps a hinge joint may be a suitable alternative. A ball joint is necessary based on the raising and lowering of the angle of the rack, as wells as the side to side degree of action based on the depression of the concave rocker. Another form that this arrangement may take on is a superior structure perpendicularly affixed to the posterior area of the rack. Said structure will be affixed with a downwardly extending shock absorber on either medial end of this structure. The titling of the rack will be absorbed by the side that the exerciser leans, and the other shock will expand telescopically. Both shocks will have their ends affixed to the posterior region of the machine (e.g., solid metal foot on the floor). Said variability of the seat tilting could be created by range limiters in the set pivots or the gas spring or shocks on the posterior region of the machine. In one embodiment illustrated in FIG. 4, the rack does not deviate up or down and rotates on two longitudinally spaced pivots that are on the same plane and directly in line across from one another.

Figure 9:
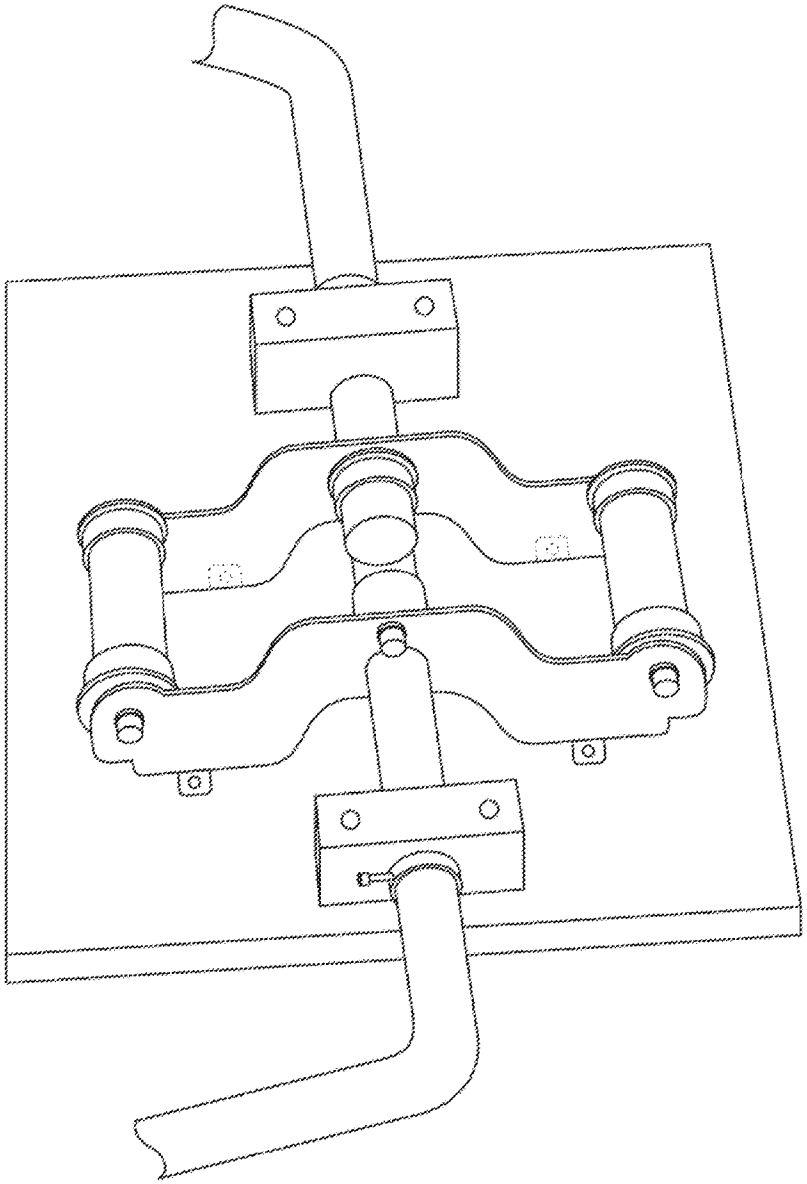
FIG. 9 is a bottom view of a seat showing a pillow block bearing of an upward support member (e.g., U-shaped support member) according to embodiments of the present disclosure.

Referring now to FIG. 9, a bottom view of a seat assembly is provided, which depicts a pillow block bearing affixed to an upward support. In some embodiments, the upward support attached to a seat via a pillow block bearings, bolts, a set of top rollers, a set of bottom rollers, and a seat plate. In some embodiments, only the seat assembly itself acts with the rail. In some embodiments, the pillow block bearings comprise range limiters. In some embodiments, the seat assembly does not affect the motion of the exerciser.

Figure 10A:
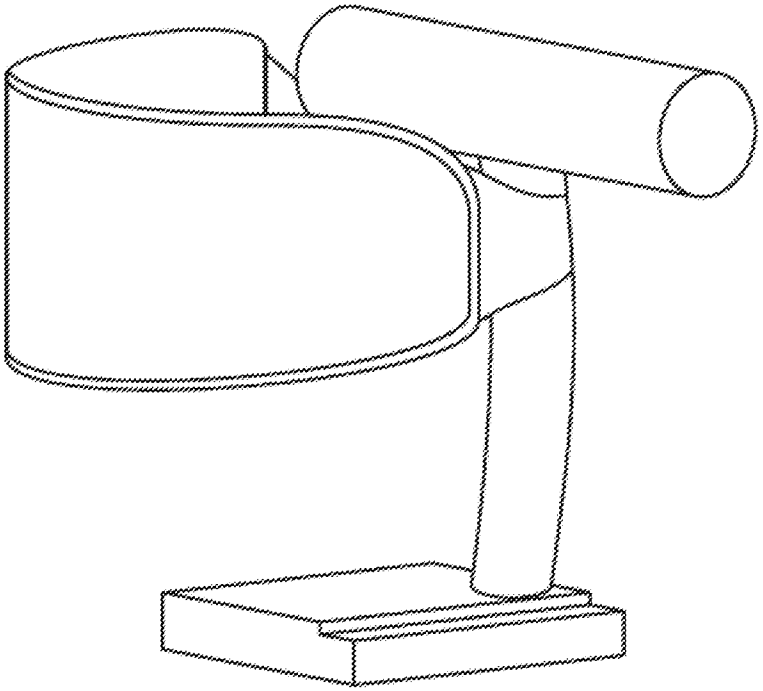
FIGS. 10A-10B show a brace affixed to a roller (FIG. 10A) and the brace affixed to a seat back (FIG. 10B) according to embodiments of the present disclosure.
Figure 10B:
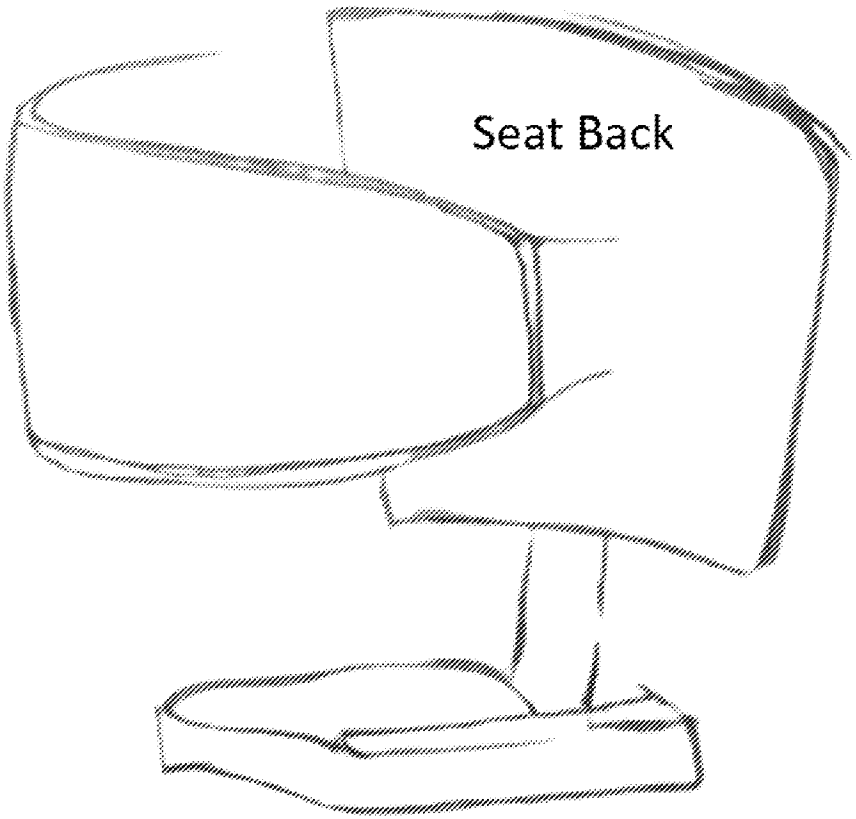

Referring now to FIGS. 10A-10B, variant brace configurations are depicted. In FIG. 10A, the posterior portion of the brace comprises a roller. In FIG. 10B, the posterior portion of the brace comprises a seat back. In some embodiments, the posterior portion of the brace can be affixed on a hinge to rotate relative to the upright support member.

Figure 11:
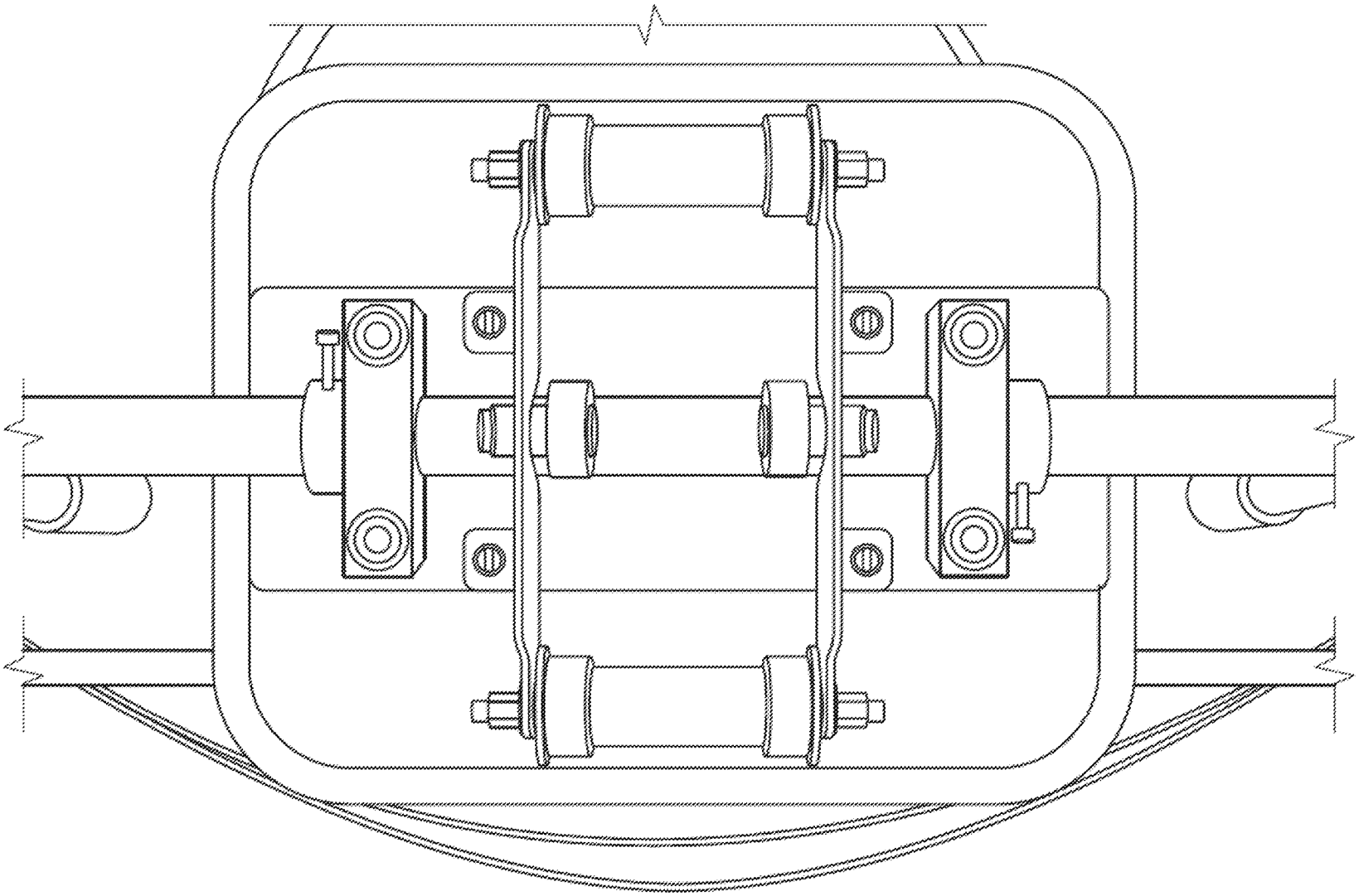
FIG. 11 is a bottom view of a seat showing a pillow block bearing of an upward support member (e.g., U-shaped support member) according to embodiments of the present disclosure.
Figure 11:
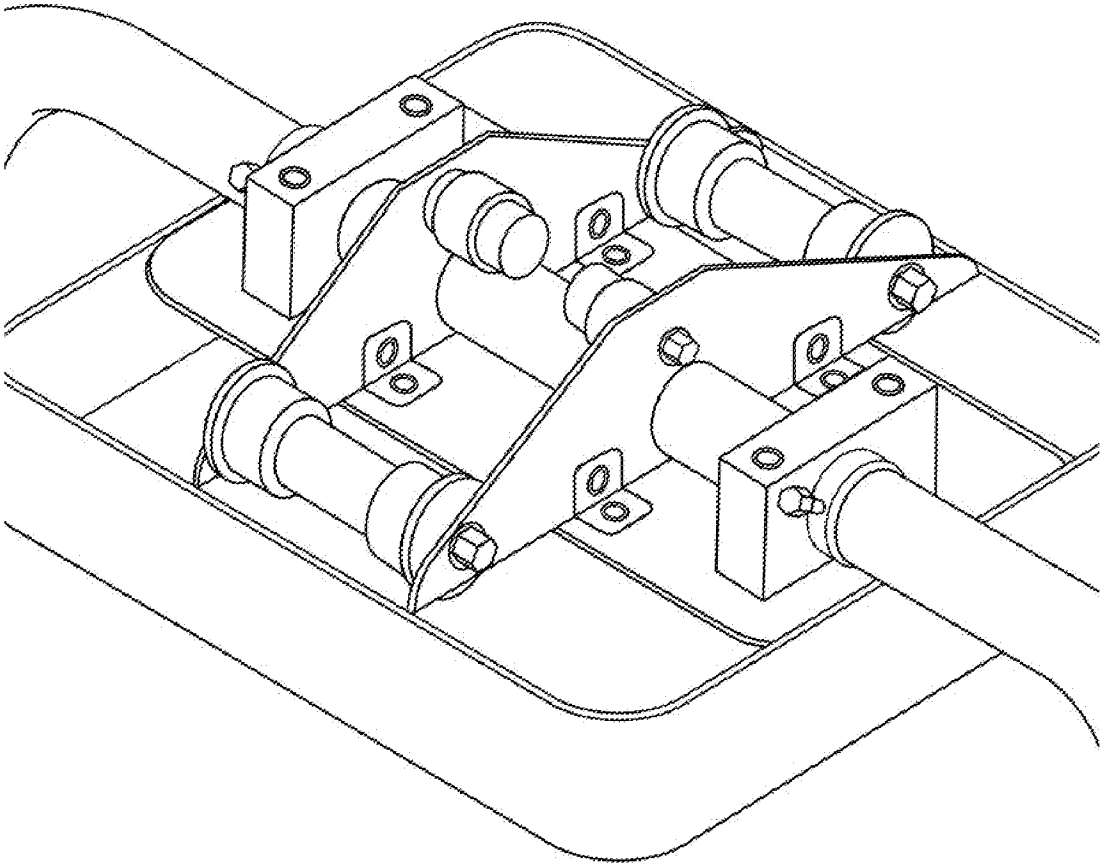

FIG. 11 is a bottom view of a seat showing a pillow block bearing securing an upward support (e.g., U-shaped support member) according to embodiments of the present disclosure.

Figure 12:
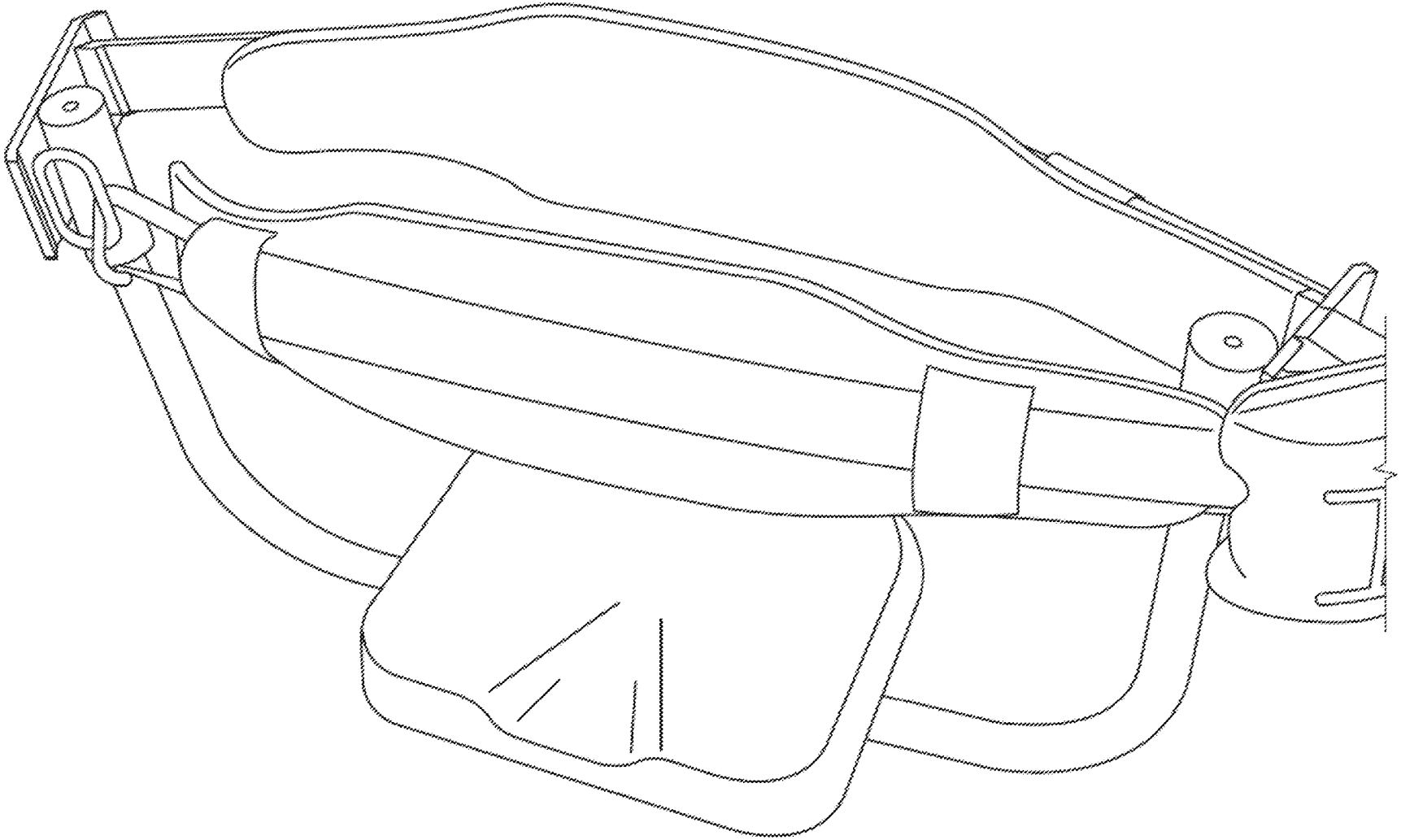
FIG. 12 is a front perspective view of a seat having an upward support (e.g., U-shaped support member) according to embodiments of the present disclosure.

FIG. 12 is a front perspective view of a seat having an upward support (e.g., U-shaped support member) according to embodiments of the present disclosure.

Figure 13:
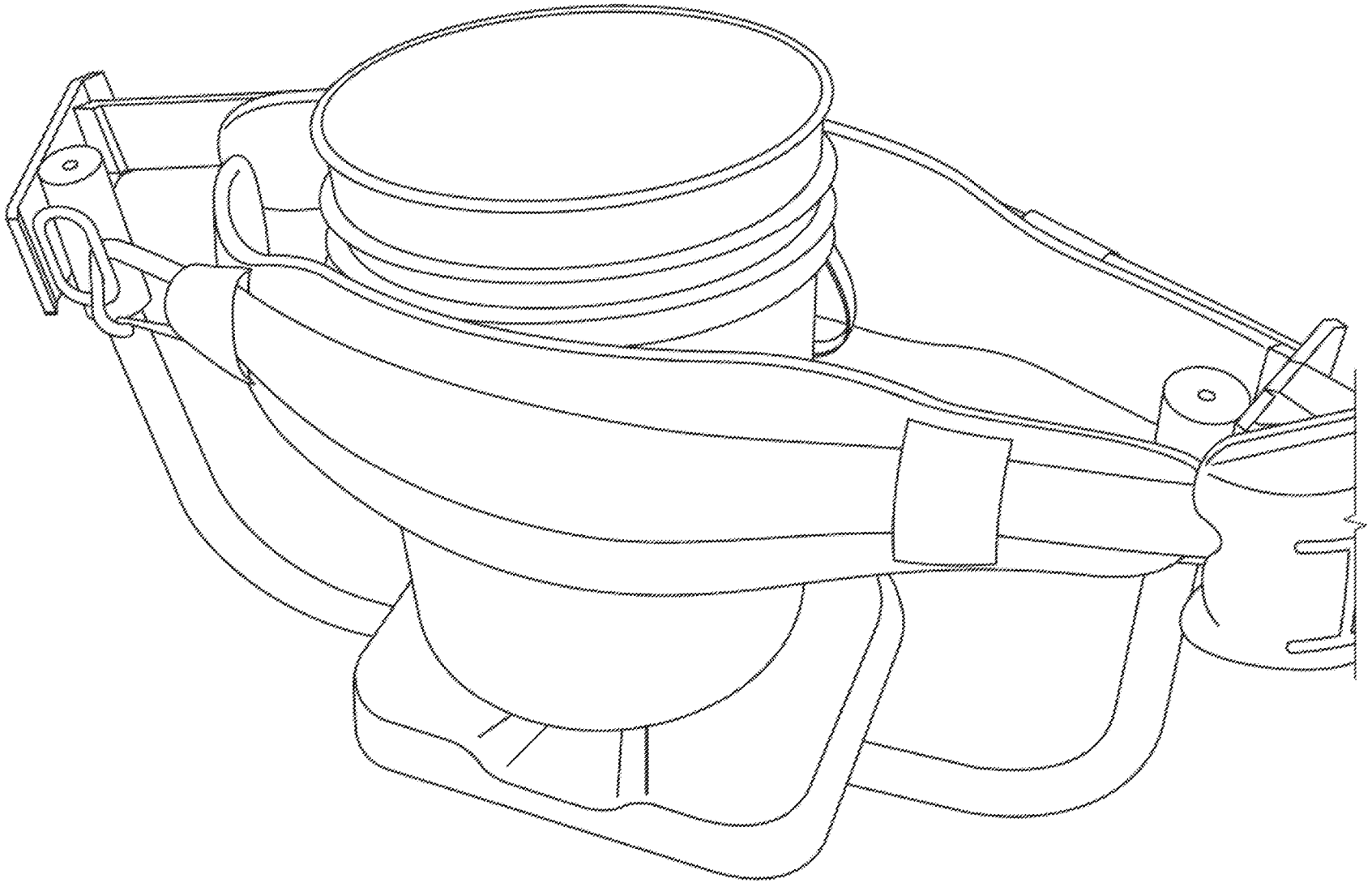
FIG. 13 is a second front perspective view of a seat having an upward support (e.g., U-shaped support member) according to embodiments of the present disclosure, illustrating deformation of a brace when the seat is occupied.

FIG. 13 is a second front perspective view of a seat having an upward support (e.g., U-shaped support member) according to embodiments of the present disclosure, illustrating deformation of a brace when the seat is occupied.

Figure 14:
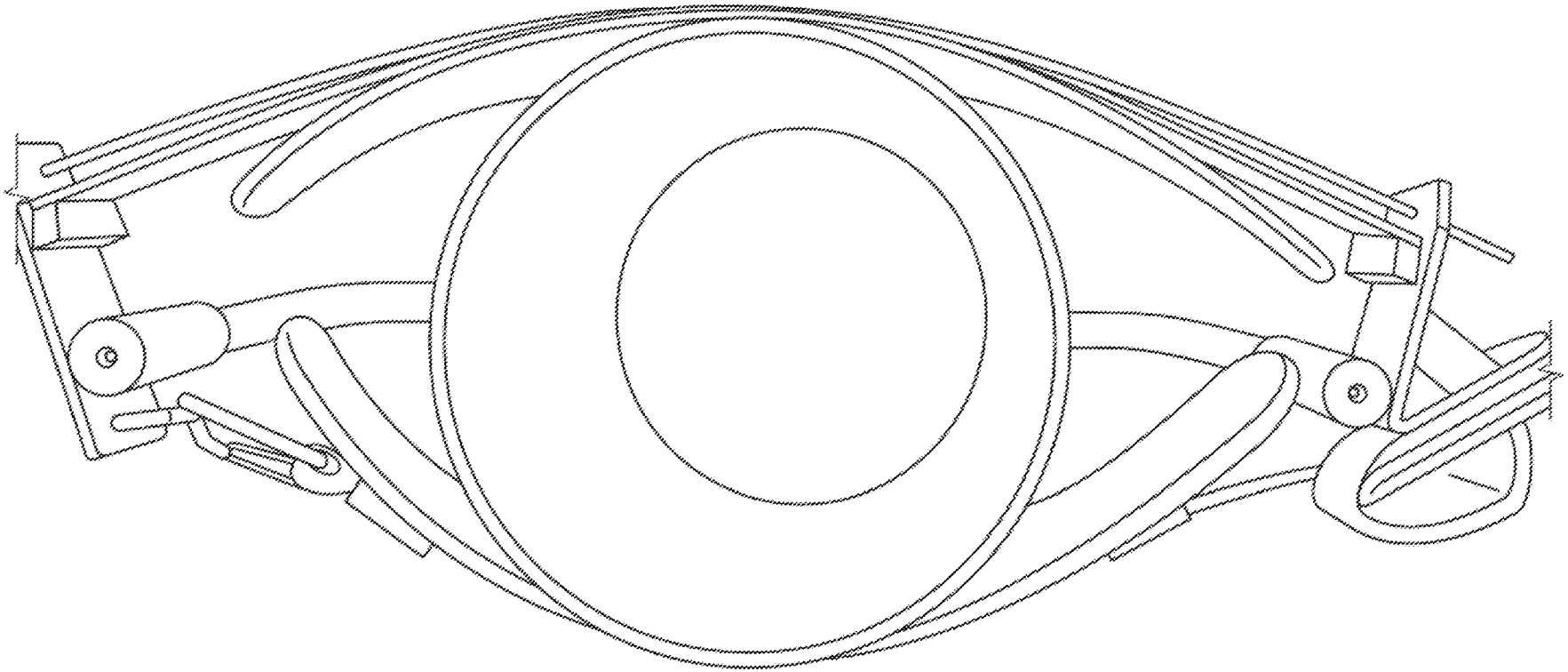
FIG. 14 is a top view of a seat having an upward support (e.g., U-shaped support member) according to embodiments of the present disclosure, illustrating deformation of a brace when the seat is occupied.

FIG. 14 is a top view of a seat having an upward support (e.g., U-shaped support member) according to embodiments of the present disclosure, illustrating deformation of a brace when the seat is occupied.

Figure 15:
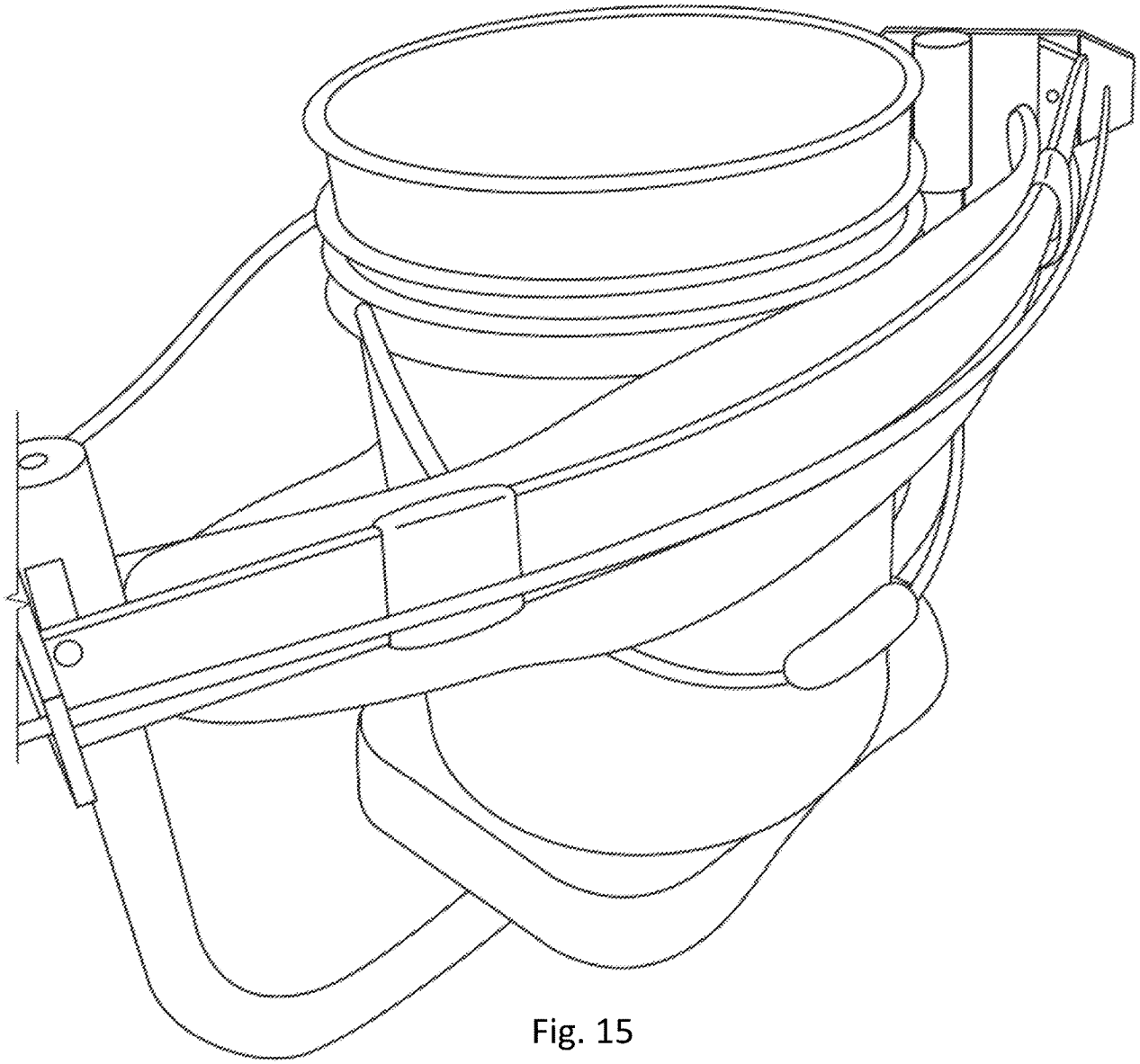
FIG. 15 is a back perspective view of a seat having an upward support (e.g., U-shaped support member) according to embodiments of the present disclosure, illustrating deformation of a brace when the seat is occupied.

FIG. 15 is a back perspective view of a seat having an upward support (e.g., U-shaped support member) according to embodiments of the present disclosure, illustrating deformation of a brace when the seat is occupied.

Figure 16:
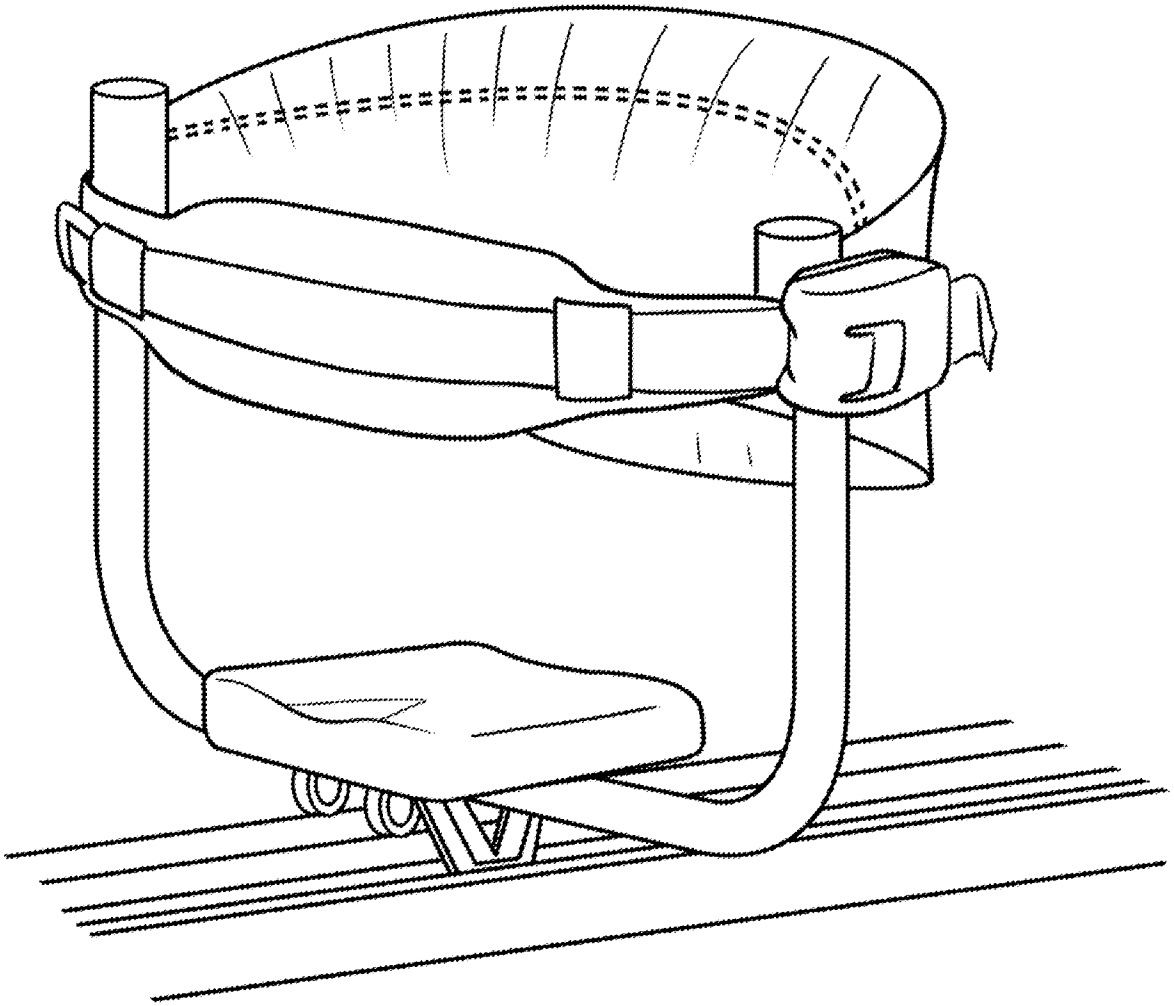
FIG. 16 is a front perspective view of a brace attached to a U-shaped support member of a rowing machine according to embodiments of the present disclosure. The dotted line illustrates an embedded structure, such as a metal bar, which creates stability between the uprights of the U-shaped member. The device utilizes the belt housing and ratchet system to create the protective compression of the device.

FIG. 16 is a front perspective view of a brace attached to a U-shaped support member of a rowing machine according to embodiments of the present disclosure. The dotted lines illustrate embedded rigid structure, such as a metal bar, that holds the uprights from collapsing inward when pressure is applied.

Figure 17A:
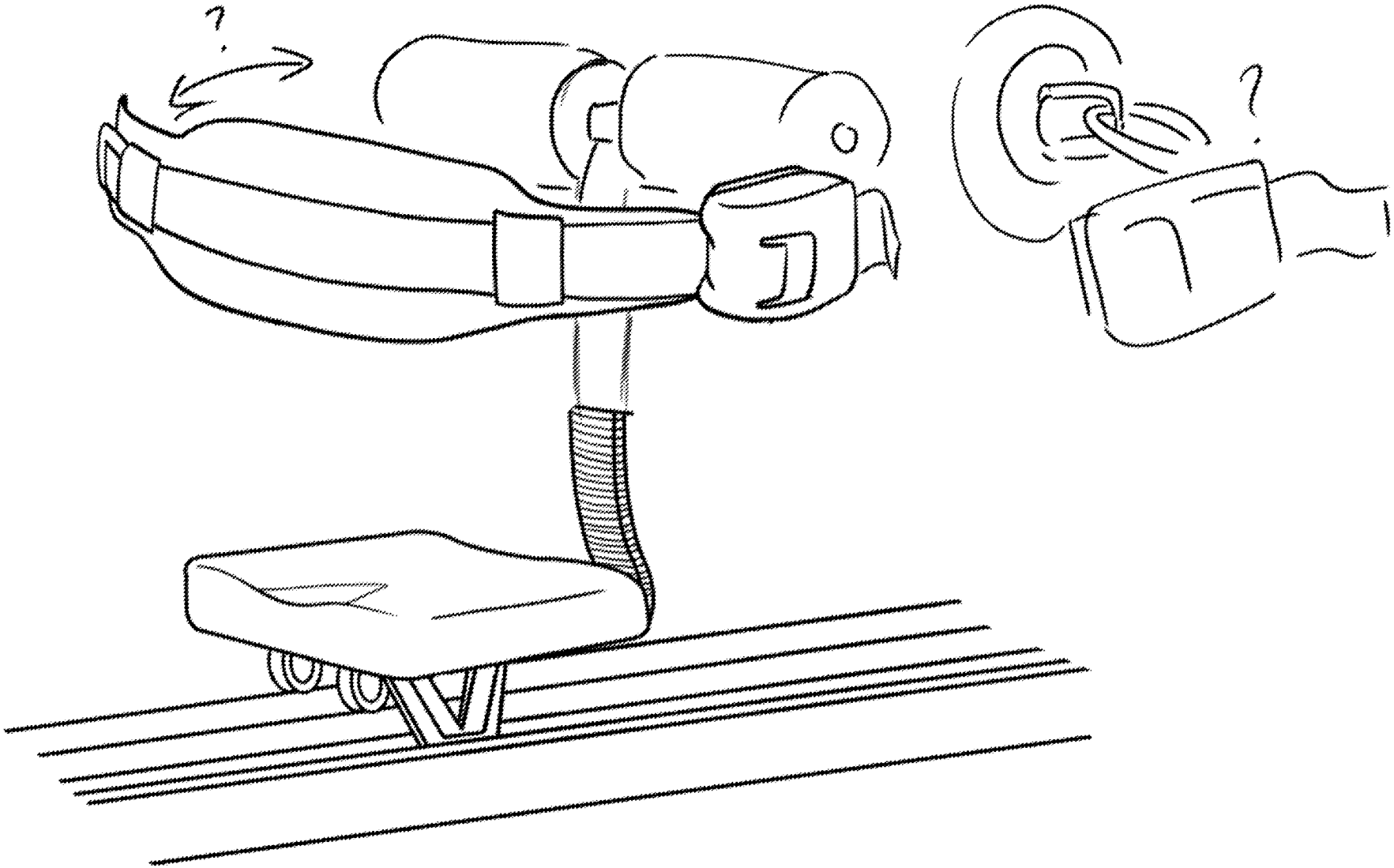
FIG. 17A is a front perspective view of a brace and roller attached to a J-shaped support member of a rowing machine according to embodiments of the present disclosure. The device utilizes the belt housing and ratchet system to create the protective compression of the device.

FIG. 17A is a front perspective view of a brace and roller attached to a J-shaped support member of a rowing machine according to embodiments of the present disclosure.

Figure 17B:
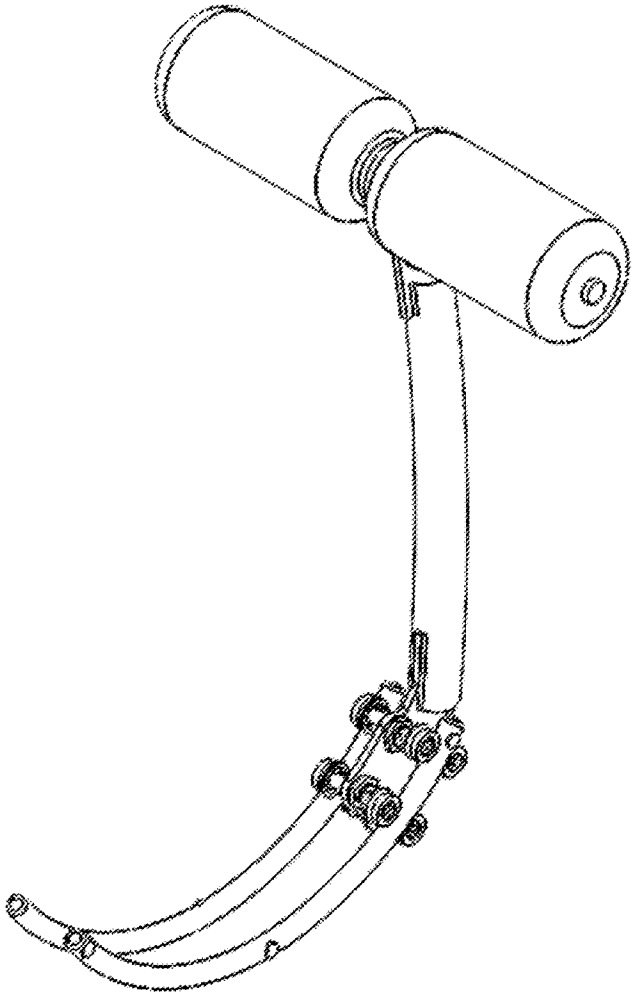
FIG. 17B is a side perspective view of a curved rail and trolley assembly.

FIG. 17B is a side perspective view of a curved rail and trolley assembly, which may be attached to a J-shaped support member. In some embodiments, the curved rail and trolley is compact in order to fit between the seat and the rail of the rowing machine. The curved rail and trolley assembly may move vertically at varying degrees. In some embodiments, movement by the curved rail and trolley assembly may produce backwards resistive force. In some embodiments, the curved rail and trolley assembly is used for sports training. In further embodiments, the curved rail and trolley assembly is used for rowing training.

Figure 17C:
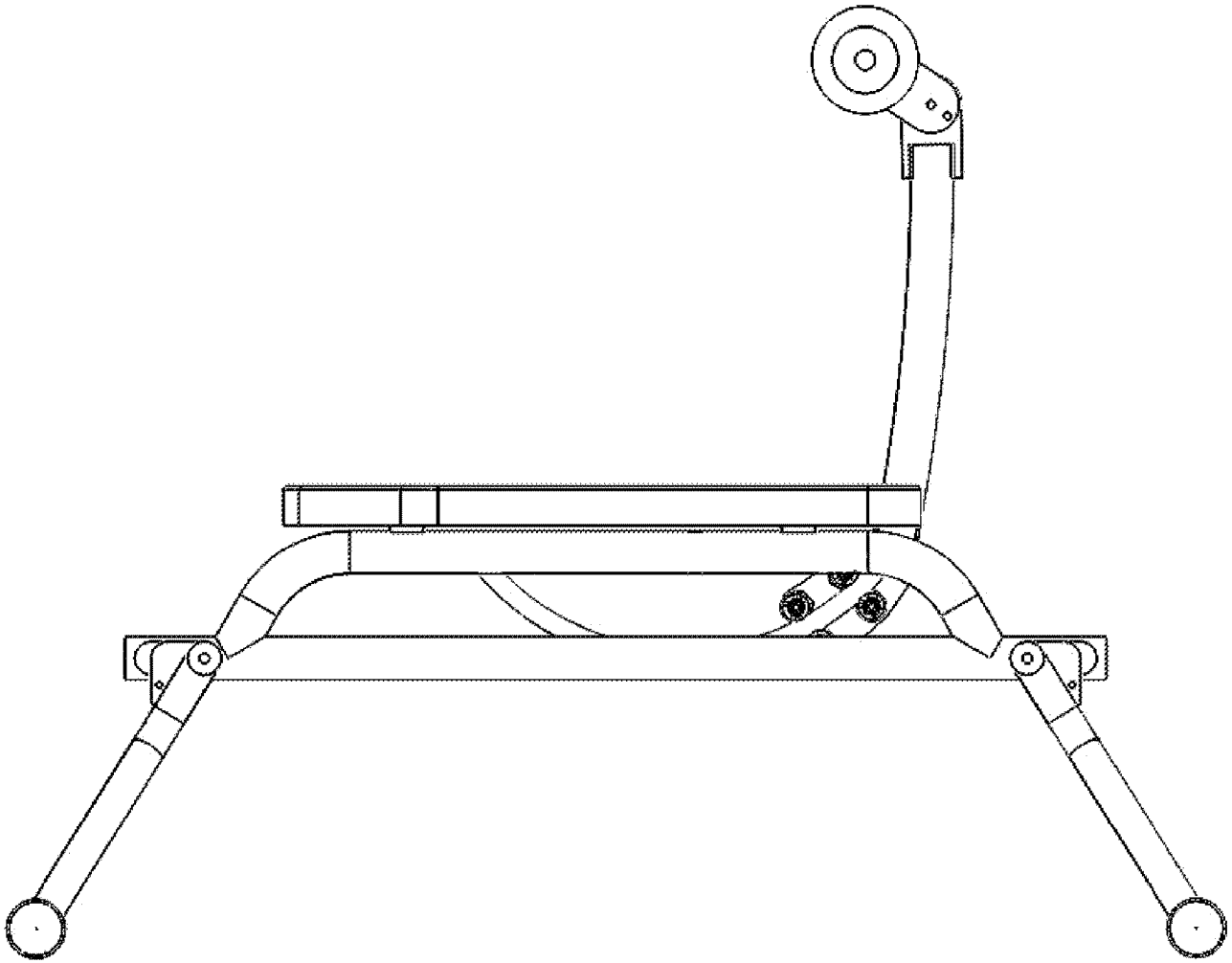
FIG. 17C is a side perspective view of a guide arm, trolley, and curved rail.

FIG. 17C is a side perspective view of a guide arm, trolley, and curved rail assembly.

Figure 18:
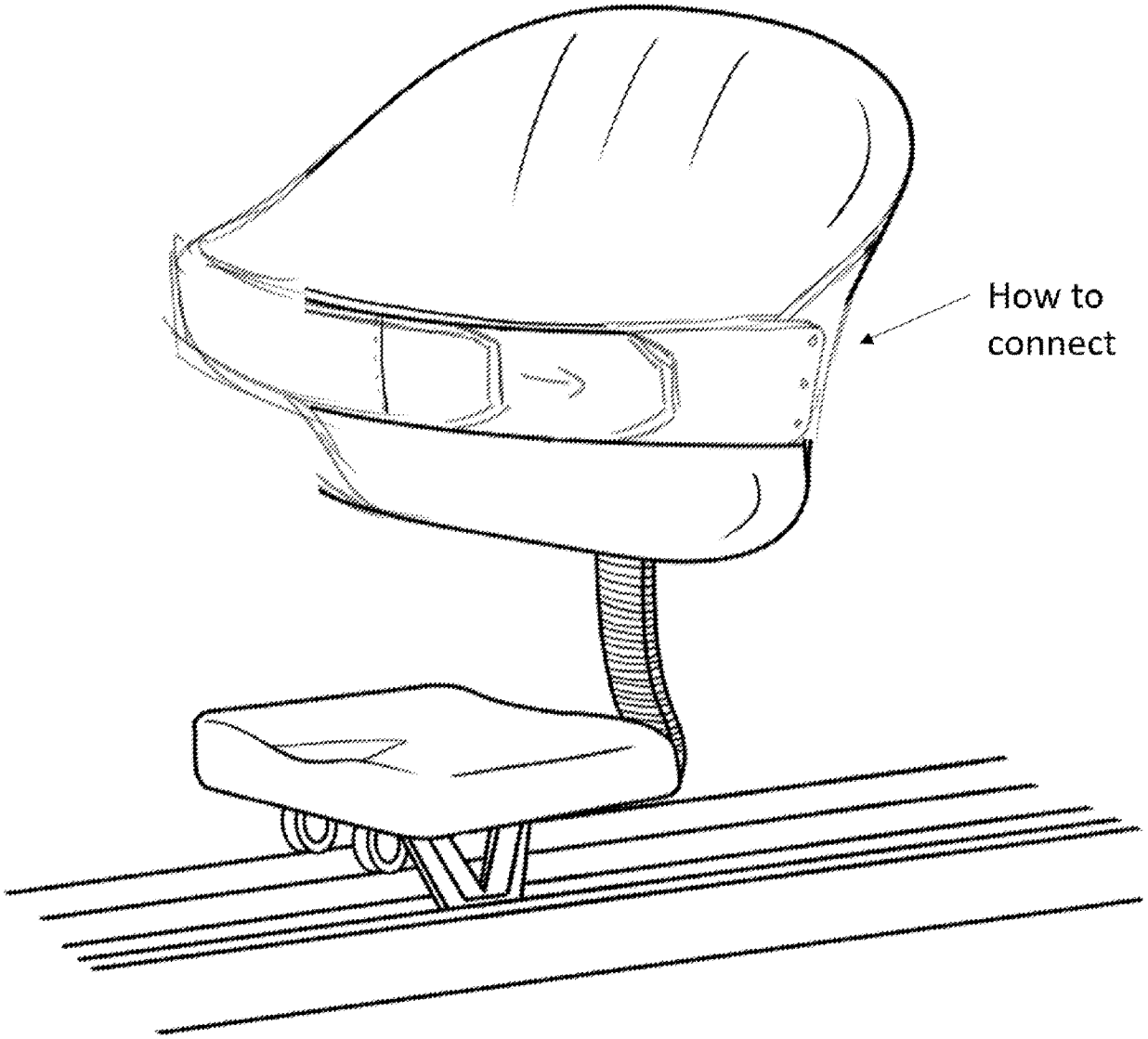
FIG. 18 is a front perspective view of a brace attached to a J-shaped support member of a rowing machine according to embodiments of the present disclosure. The device utilizes a hook-and-pile or hook-and-loop closure. Both ends are fixed to the sides of the seat back by any means of attachment, industrial adhesive, nut and bolt, rivets or by sewing a loop through an aperture.

FIG. 18 is a front perspective view of a brace attached to a J-shaped support member of a rowing machine according to embodiments of the present disclosure. Said J shaped member is supporting a chair back, the closure in the front of the brace comprises two belt-like elements, each secured to the lateral left and lateral right sides of the chair back. These securements may take the form of any permanent affixing method. To create the closure, the user pulls one side of the belt and then, using the hook-and-pile or hook-and-loop feature, creates a tight, secure, and comfortable brace about the abdomen.

Figure 19:
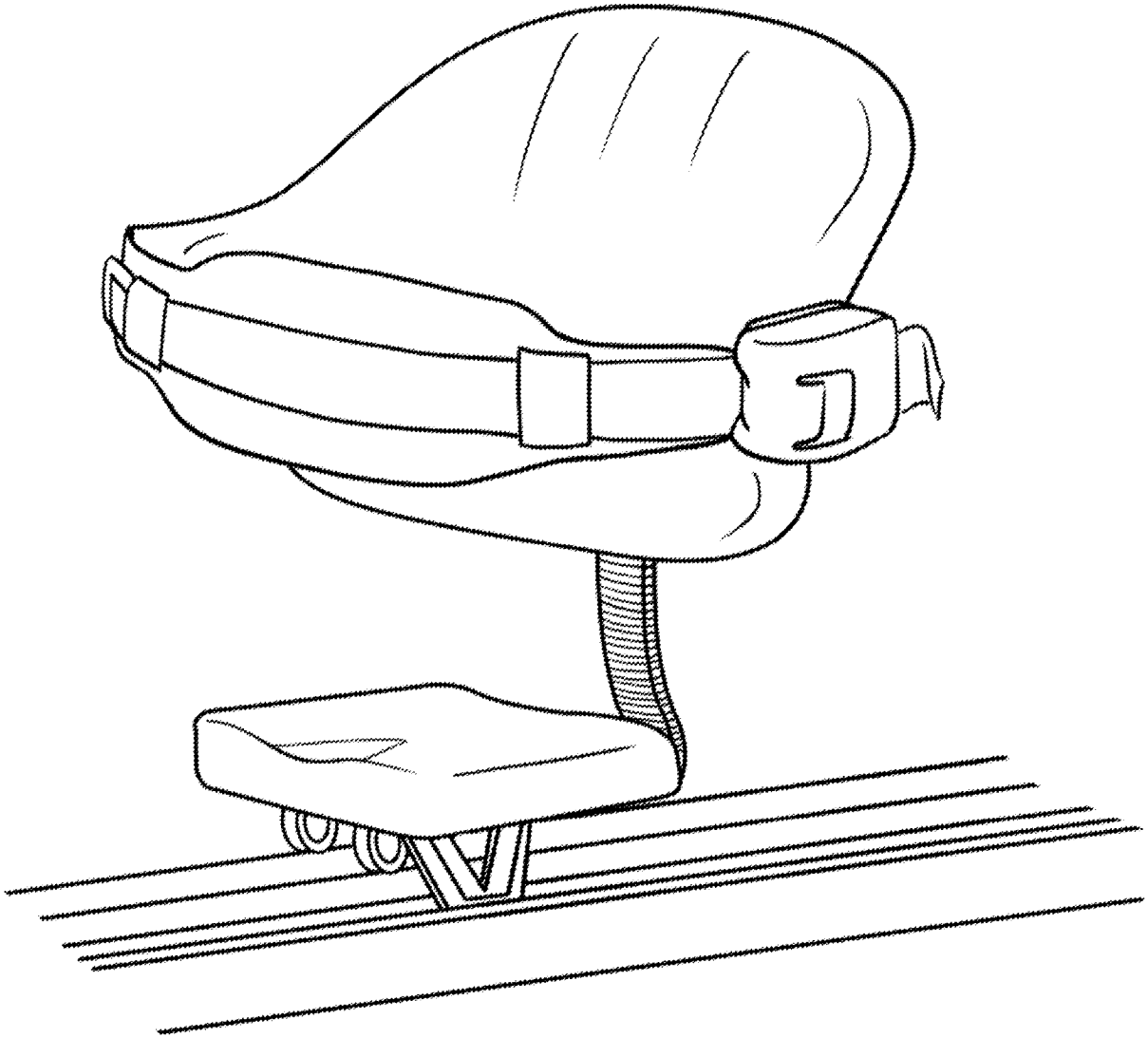
FIG. 19 is a front perspective view of a brace attached to a J-shaped support member of a rowing machine according to embodiments of the present disclosure. The device utilizes the belt housing and ratchet system to create the protective compression of the device.

FIG. 19 is a front perspective view of a brace attached to a J-shaped support member of a rowing machine according to embodiments of the present disclosure. In some embodiments, the J-shaped support member comprises a rubber protective material. On the left side a ratchet housing and belt assembly are attached and may oscillate. The belt is pulled through the loops on the anterior portion of the brace. The end of the belt is clasped to the right side of the chair back. The user applies the action of the ratchet to create protective compression.

Figure 20:
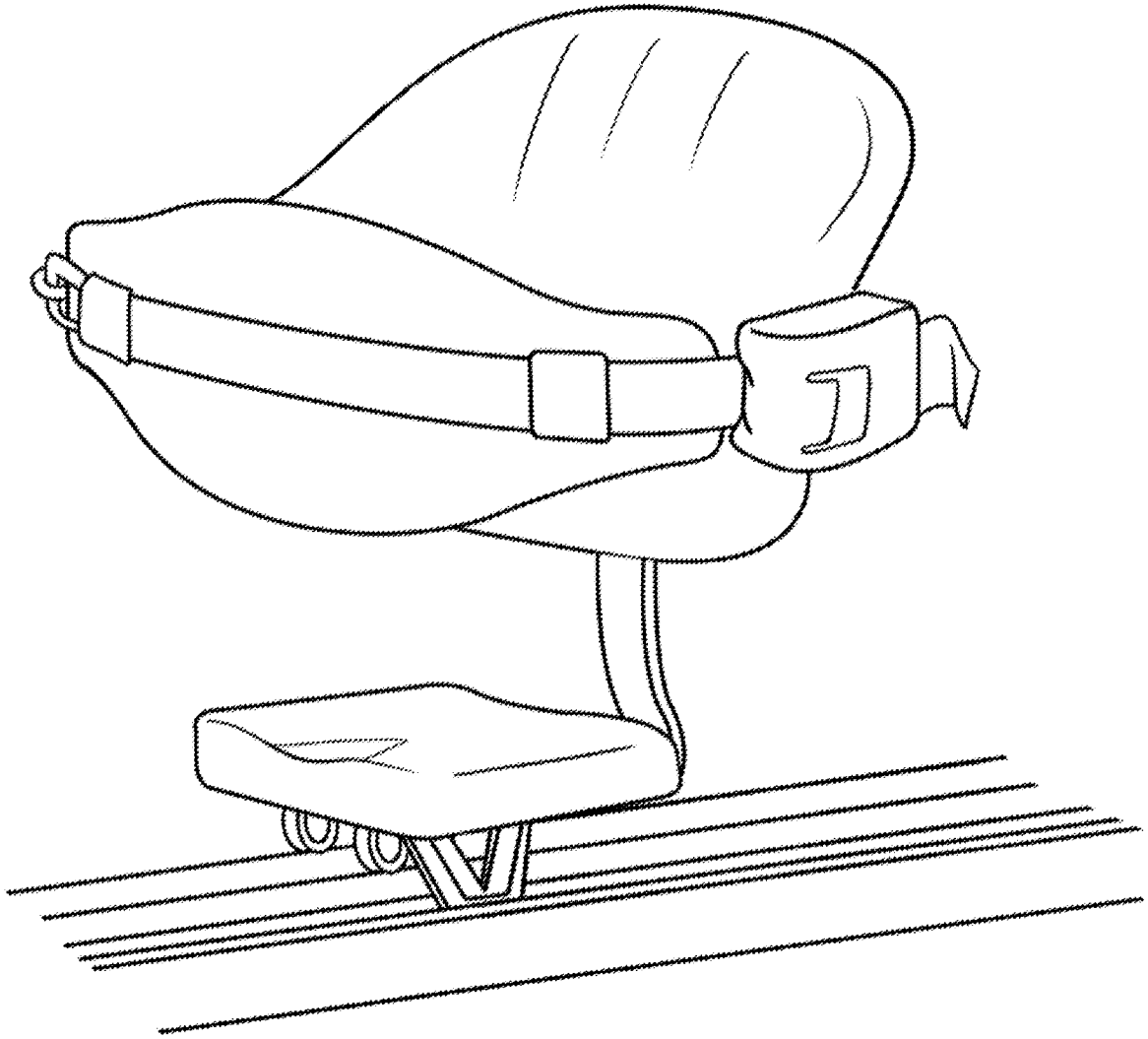
FIG. 20 is a front perspective view of a brace attached to a J-shaped support member of a rowing machine according to embodiments of the present disclosure. The device utilizes the belt housing and ratchet system to create the protective compression of the device.

FIG. 20 is a front perspective view of a brace attached to a J-shaped support member of a rowing machine according to embodiments of the present disclosure. In some embodiments, the J-shaped support member comprises a rubber protective material. On the left side, a ratchet housing and belt assembly are attached to the J-shaped support member. The belt is pulled through the loops on the anterior portion of the brace. The end of the belt is clasped to the right side of the chair back. The user applies the action of the ratchet to create protective compression.

Figure 21:
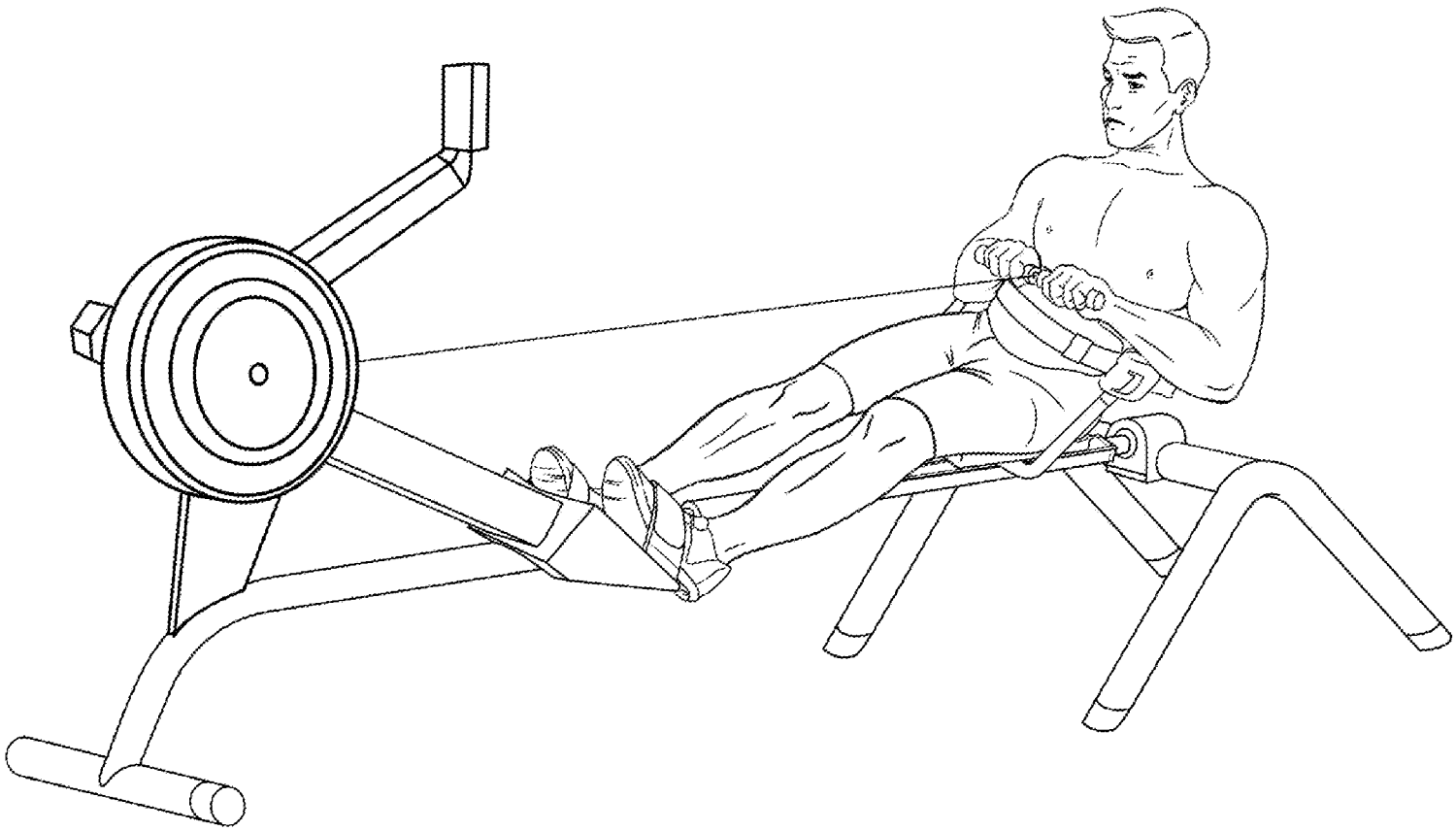
FIG. 21 is a front view of a protective rowing device having stirrups in use by a rower according to embodiments of the present disclosure.

FIG. 21 is a front view of a protective rowing device having stirrups in use by a rower according to embodiments of the present disclosure. The belt is also secured across the front of the exerciser.

Figure 22:
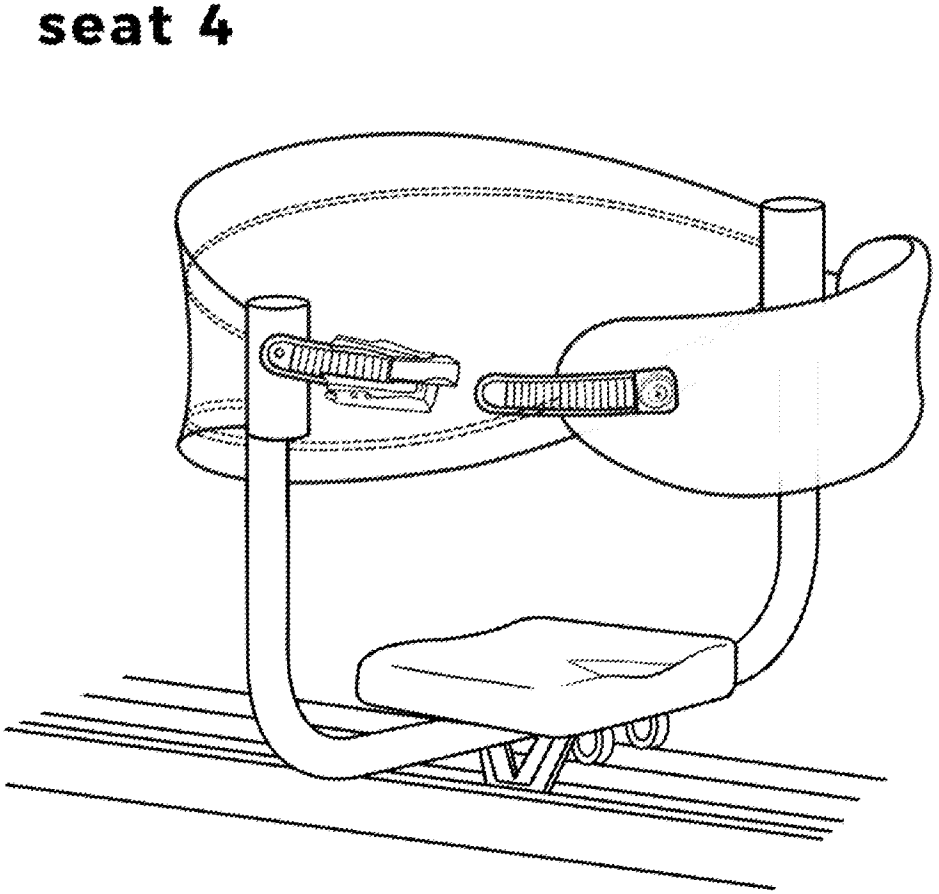
FIG. 22 is a front perspective view of a brace comprising a posterior rigid seat back and a flexible anterior strap-in binding (e.g., snowboard binding) attached to a U-shaped support member of a rowing machine according to embodiments of the present disclosure. The dotted lines illustrate an embedded rigid structure, such as a metal bar, that holds the uprights of the U-shaped support member from collapsing inward when pressure is applied.

FIG. 22 is a front perspective view of a brace comprising a posterior rigid seat back and a flexible anterior strap-in binding (e.g., snowboard binding) attached to a U-shaped support member of a rowing machine according to embodiments of the present disclosure. The dotted lines illustrate an embedded rigid structure, such as a metal bar, that holds the uprights of the U-shaped support member from collapsing inward when pressure is applied.

Figure 23:
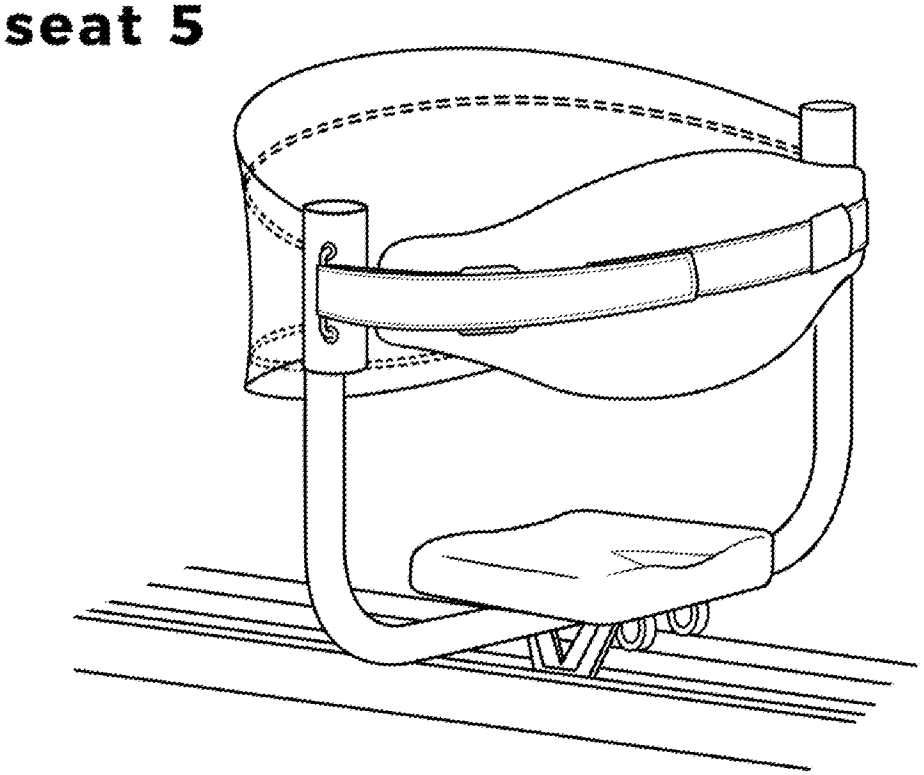
FIG. 23 is a front perspective view of the brace comprising a rigid posterior and a flexible anterior belt comprising a hook-and-pile or hook-and-loop feature on one end and a permanent attachment, such as nut and bolt, on the other end. Said belt comprises a wider padded feature. The user places the pad and belt across his or her abdomen and loops one end through the clasp on the other end. The user may pull the belt tight and secure the belt back onto itself via the hook-and-pile or hook-and-loop feature.

FIG. 23 is a front perspective view of the brace comprising a rigid posterior and a flexible anterior belt comprising a hook-and-pile or hook-and-loop feature on one end and a permanent attachment, such as nut and bolt, on the other end. Said belt comprises a wider padded feature. The user places the pad and belt across his or her abdomen and loops one end through the clasp on the other end. The user may pull the belt tight and secure the belt back onto itself via the hook-and-pile or hook-and-loop feature.

Figure 24A:
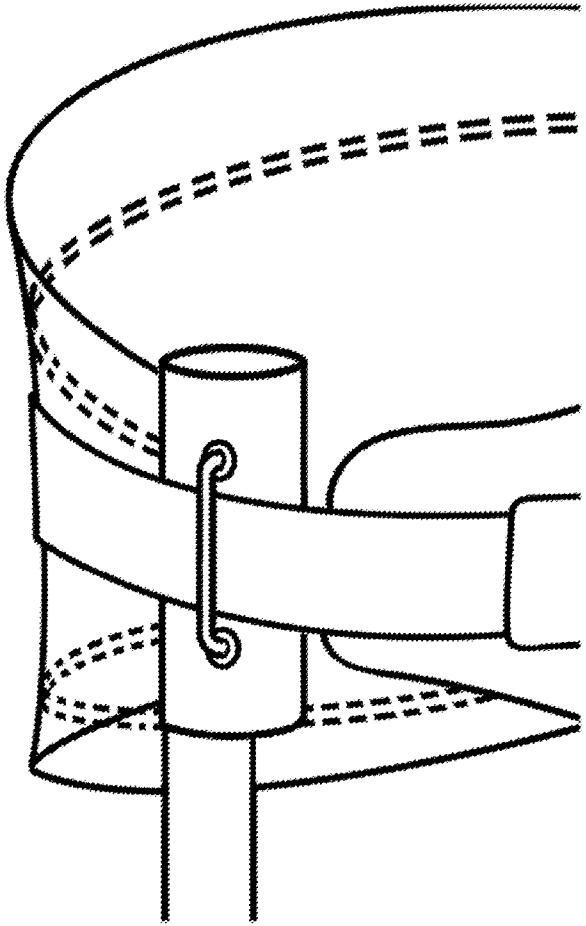
FIG. 24A is a front perspective view of the brace comprising a rigid posterior and a flexible anterior belt comprising a hook-and-pile or hook-and-loop feature on one end and a permanent attachment, such as nut and bolt, on the other end. Said belt comprises a wider padded feature. The user secures the belt to the back of the rigid posterior, which is equipped with a hook-and-pile or hook-and-loop attachment mechanism.

FIG. 24A is a front perspective view of the brace comprising a rigid posterior and a flexible anterior belt comprising a hook-and-pile or hook-and-loop feature on one end and a permanent attachment, such as nut and bolt, on the other end. Said belt comprises a wider padded feature. The user secures the belt to the back of the rigid posterior, which is equipped with a hook-and-pile or hook-and-loop attachment mechanism.

Figure 24B:
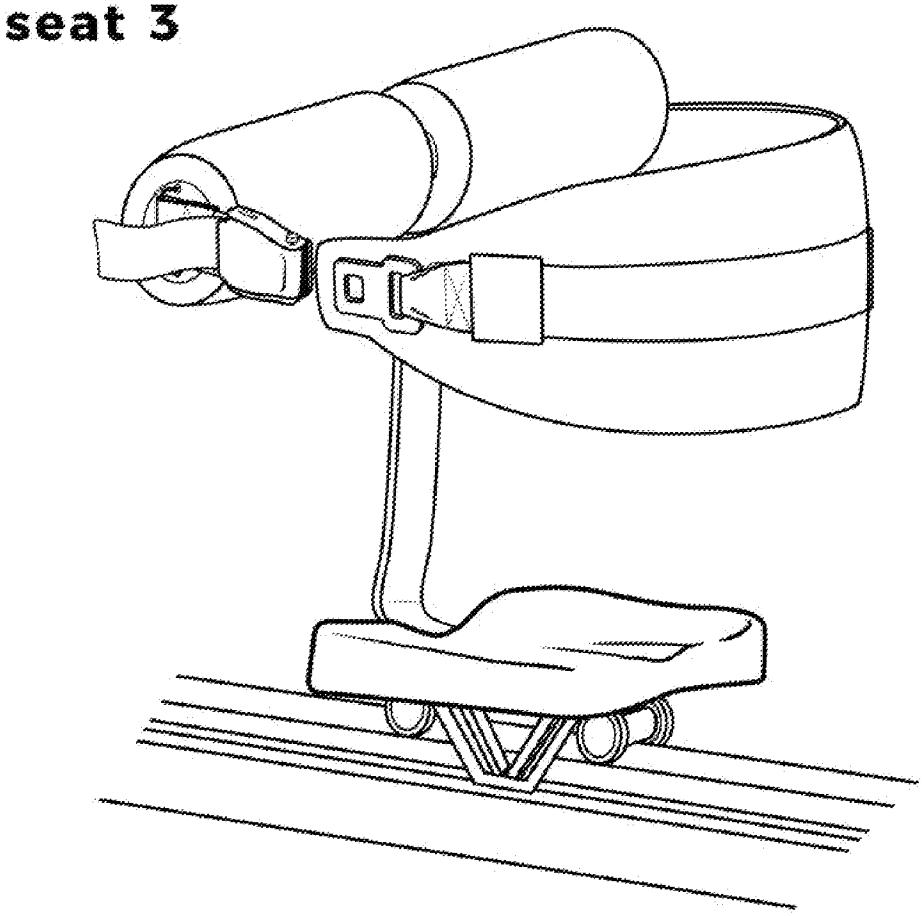
FIG. 24B is a front perspective view of the brace comprising a rigid posterior which comprises rollers supported by a J-shaped support and a flexible anterior belt comprising a seat belt latch on one end and a permanent attachment, such as nut and bolt, on another end for use on a rowing machine. Said seat belt comprises a wide padded feature. The user places the pad and belt across his or her abdomen and depresses the metal latch into the clasp on one end. He or she pulls the end of the belt to cinch himself or herself to create protective compression.

FIG. 24B is a front perspective view of the brace comprising a rigid posterior which comprises rollers supported by a J-shaped support and a flexible anterior belt comprising a seat belt latch on one end and a permanent attachment, such as nut and bolt, on another end for use on a rowing machine. Said seat belt comprises a wide padded feature. The user places the pad and belt across his or her abdomen and depresses the metal latch into the clasp on one end. He or she pulls the end of the belt to cinch himself or herself to create protective compression.

Figure 25:
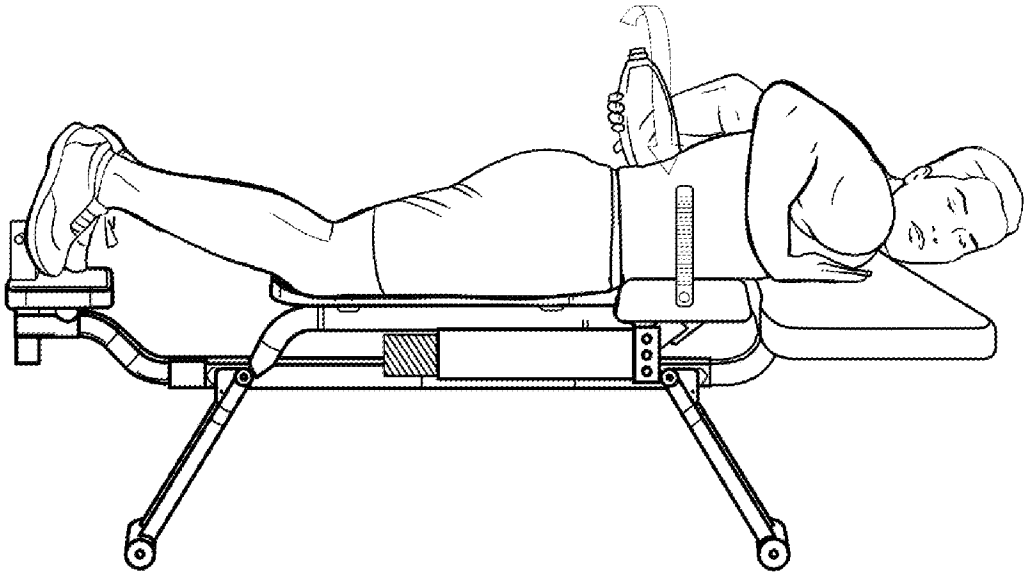
FIG. 25 is a side view of the brace comprising a rigid anterior and a posterior strap-in binding (e.g., snowboard binding) for use on a push-up machine or plank machine. The exerciser is shown reaching back and placing the binding over his or her back to engage the ratchet strip on the other side of the brace. When the two ends are placed together, the user employs the ratchet on the ratchet strip to secure the wide part of the binding and to create protective compression in the entire torso.

FIG. 25 is a side view of the brace comprising a rigid anterior and a posterior strap-in binding (e.g., snowboard binding) for use on a push-up machine or plank machine. The exerciser is shown reaching back and placing the binding over his or her back to engage the ratchet strip on the other side of the brace. When the two ends are placed together, the user employs the ratchet on the ratchet strip to secure the wide part of the binding and to create protective compression in the entire torso. In some embodiments, the ratchet is on the strap-in binding (e.g., snowboard binding) or embedded in the strap-in binding (e.g., snowboard binding).

Figure 26:
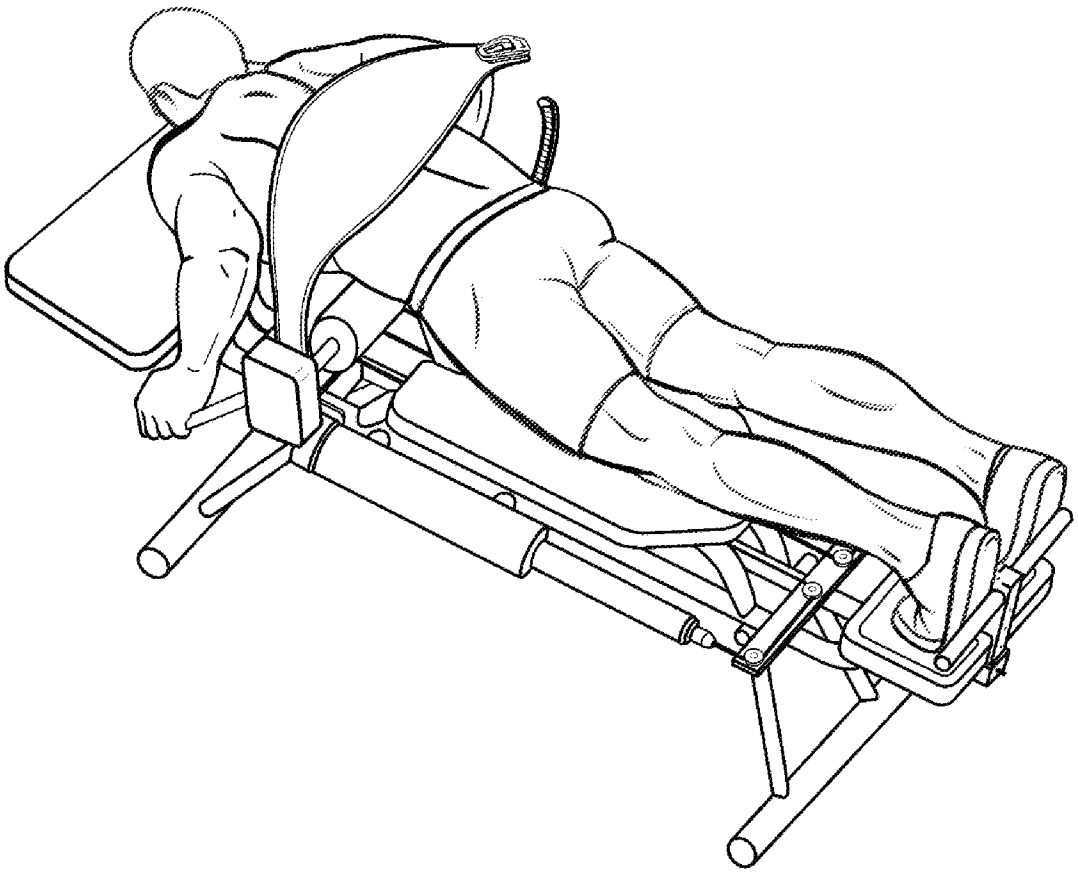
FIG. 26 is a rear perspective view of the brace comprising a rigid anterior and a flexible posterior strap-in binding (e.g., snowboard binding) for use on a push-up machine or plank machine. The exerciser has his or her hand on a lever that, when depressed, will release the binding, which is secured in a quick release mechanism. When the binding falls it will engage the ratchet strip on the other side. The user employs the ratchet to create protective compression. This method is designed as a means to replace having to meet the hands behind the user's back.

FIG. 26 is a rear perspective view of the brace comprising a rigid anterior and a flexible posterior strap-in binding (e.g., snowboard binding) for use on a push-up machine or plank machine. The exerciser has his or her hand on a lever that, when depressed, will release the binding, which is secured in a quick release mechanism. When the binding falls it will engage the ratchet strip on the other side. The user employs the ratchet to create protective compression. This method is designed as a means to replace having to meet the hands behind the user's back.

Figure 27:
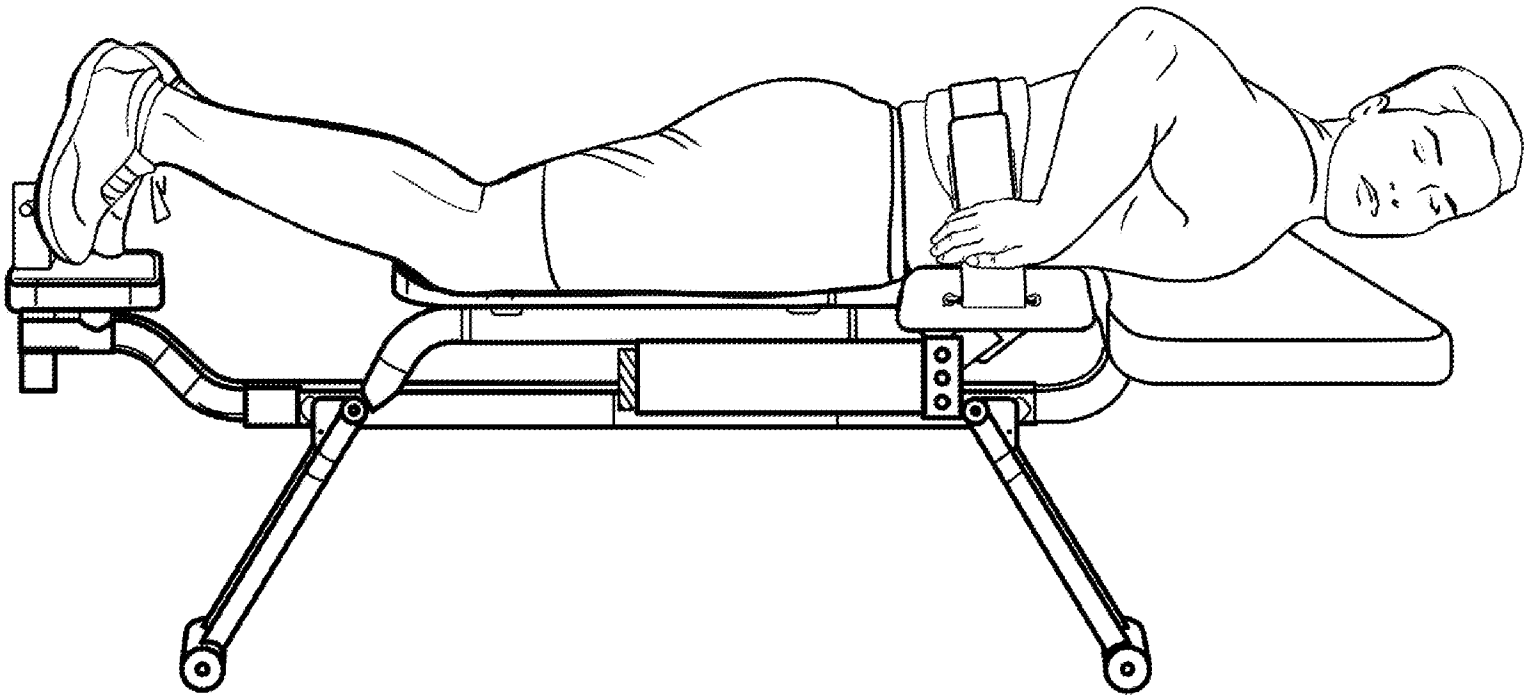
FIG. 27 is a side view of the brace comprising a rigid anterior and a flexible posterior belt comprising a hook-and-pile or hook-and-loop attachment mechanism on one end and a permanent attachment, such as nut and bolt, on the other end for use on a push-up machine or plank machine. Said belt comprises a wide padded feature. The user places the pad and belt across his or her back and loops the end through the clasp on the other side. He or she pulls the belt tight and secure the belt back onto itself via the hook-and-pile or hook-and-loop feature.

FIG. 27 is a side view of the brace comprising a rigid anterior and a flexible posterior belt comprising a hook-and-pile or hook-and-loop attachment mechanism on one end and a permanent attachment, such as nut and bolt, on the other end for use on a push-up machine or plank machine. Said belt comprises a wide padded feature. The user places the pad and belt across his or her back and loops the end through the clasp on the other side. He or she pulls the belt tight and secure the belt back onto itself via the hook-and-pile or hook-and-loop feature.

Figure 28:
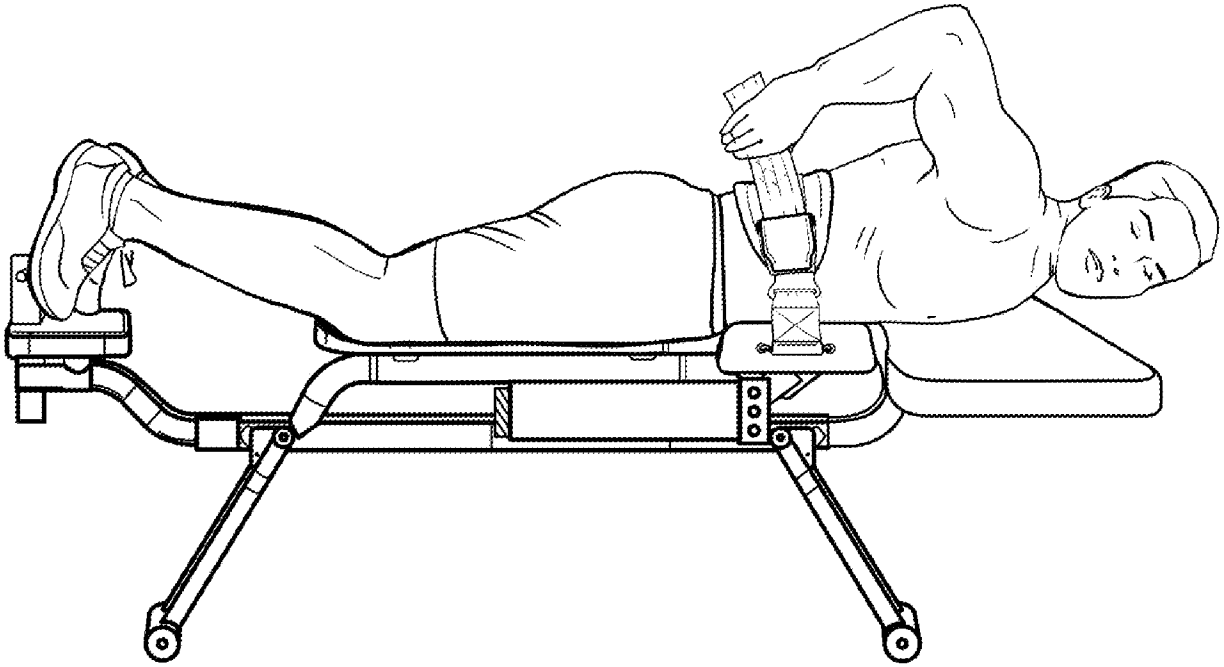
FIG. 28 is a side view of the brace comprising a rigid anterior and a flexible posterior belt comprising a seat belt latch on one end and a permanent attachment, such as nut and bolt, on the other for use on a push-up machine or plank machine. Said seat belt comprises a wider padded feature. The user moves the pad and belt across his or her back and depresses the metal latch into the clasp on the other side. He or she pulls the end of the belt to cinch himself or herself to create protective compression.

FIG. 28 is a side view of the brace comprising a rigid anterior and a flexible posterior belt comprising a seat belt latch on one end and a permanent attachment, such as nut and bolt, on the other for use on a push-up machine or plank machine. Said seat belt comprises a wider padded feature. The user moves the pad and belt across his or her back and depresses the metal latch into the clasp on the other side. He or she pulls the end of the belt to cinch himself or herself to create protective compression.

Figure 29:
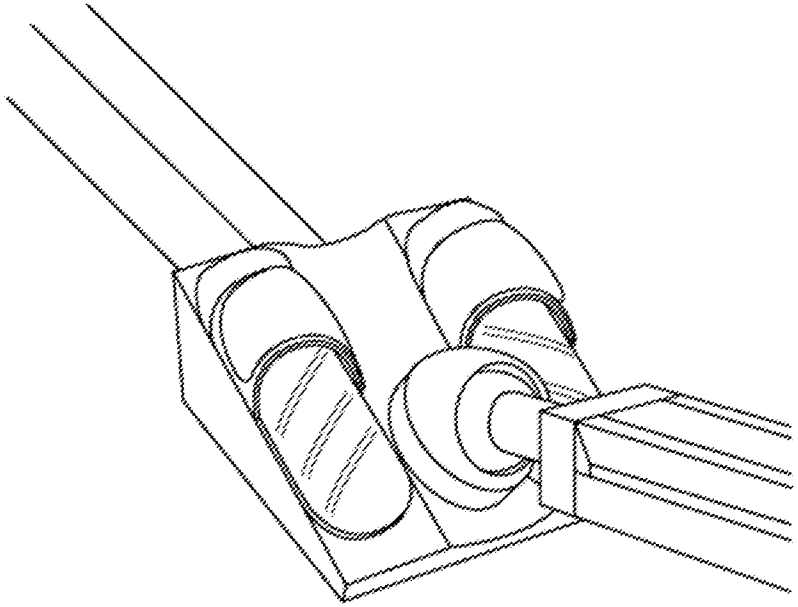
FIG. 29 is a rear perspective view of a ball and socket joint being employed to provide multi-axial tilting on a rowing machine.

FIG. 29 is a rear perspective view of a ball and socket joint being employed to provide multi-axial tilting on a rowing machine.

Figure 30A:
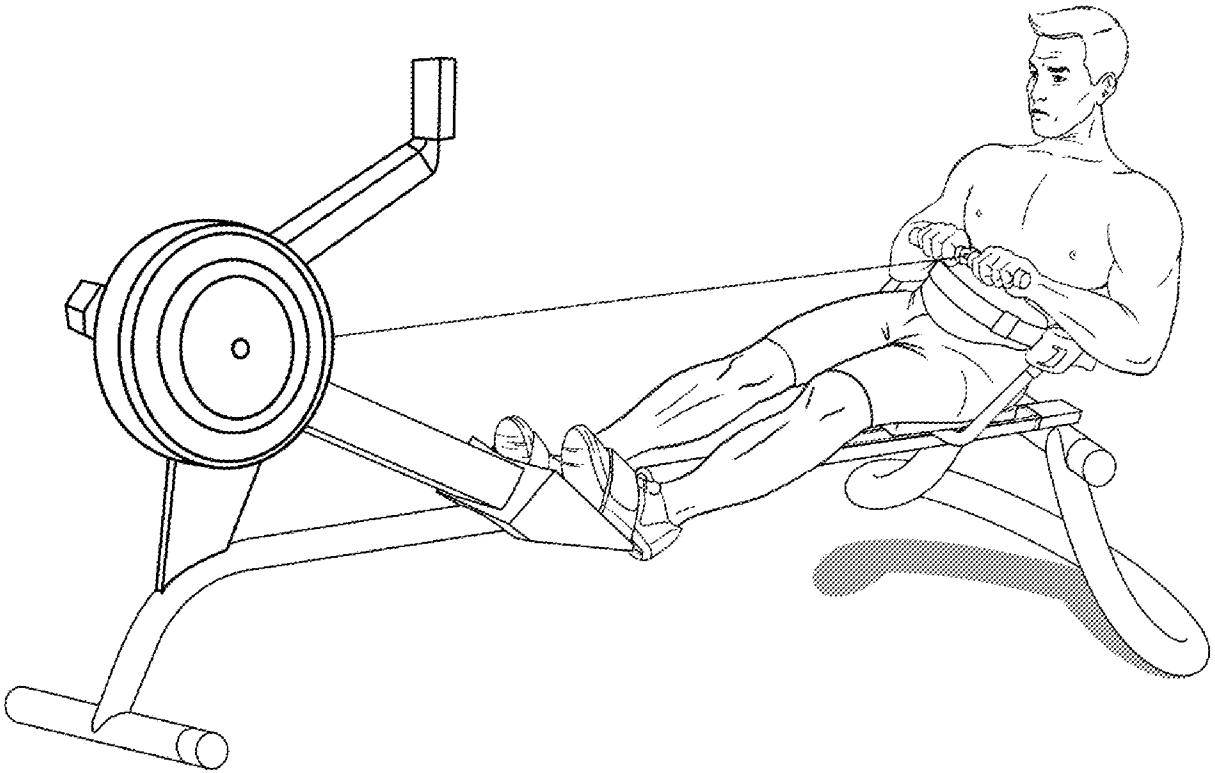
FIG. 30A and FIG. 30B are front perspective views of a rowing machine employing the compressive and protective brace. The device comprises an inferior end that is made in the shape of a rocker, as shown in FIG. 8.
Figure 30B:
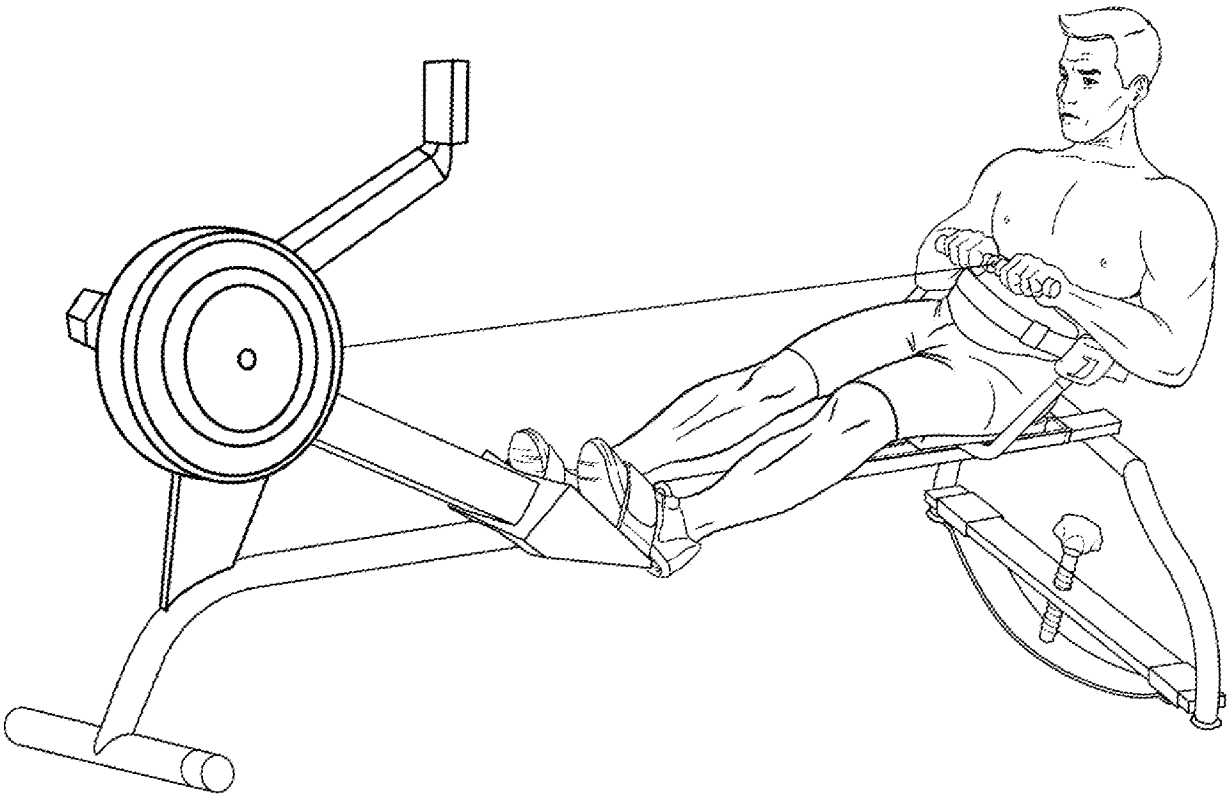

FIG. 30A and FIG. 30B are front perspective views of a rowing machine employing the compressive and protective brace. The device comprises an inferior end that is made in the shape of a rocker, as shown in FIG. 8.

Figure 31:
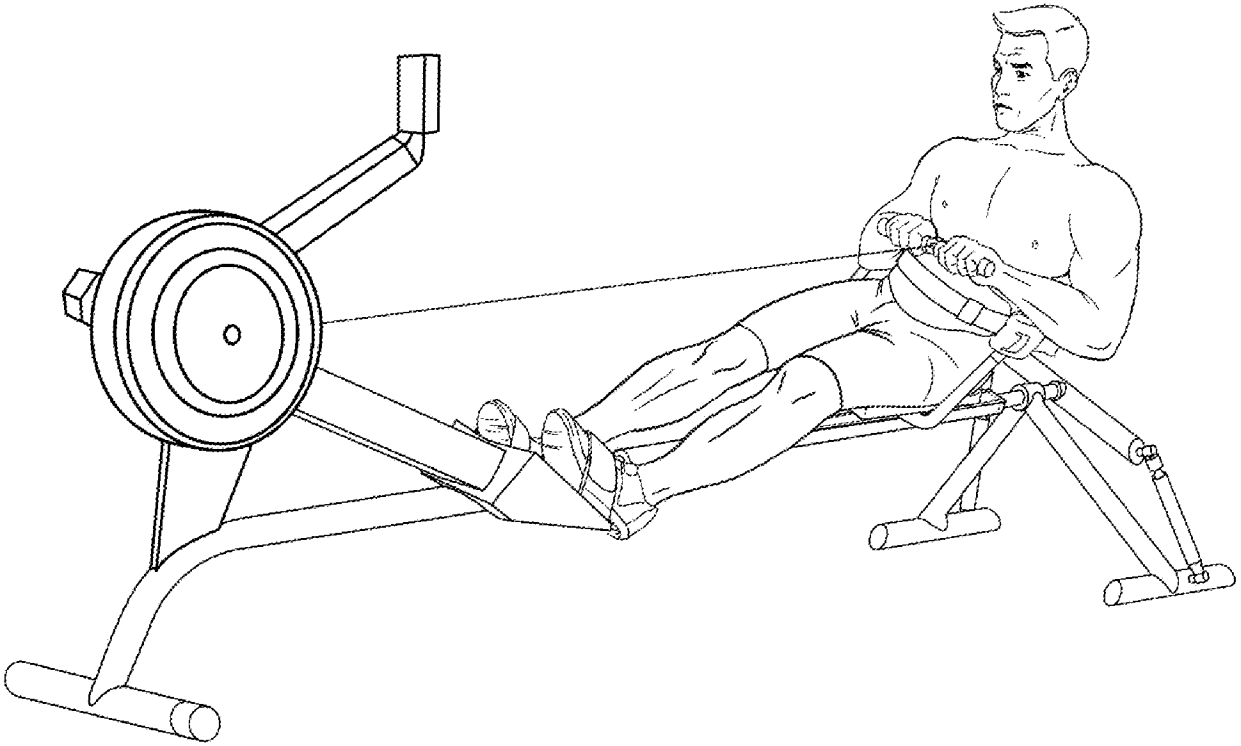
FIG. 31 is a front perspective view of a rowing machine employing the compressive and protective brace. The device comprises an inferior end, which includes a member fixed perpendicular to the rack. Said perpendicular member is attached on below the pivot of the rack. Said perpendicular member includes a gas spring or variable resistance shock on each medial end. Said variable resistance shocks may act as dampeners to absorb the left and right tilting that the exerciser may employ.

FIG. 31 is a front perspective view of a rowing machine employing the compressive and protective brace. The device comprises a posterior end, which includes a member fixed perpendicular to the rack. Said perpendicular member is attached on behind the pivot of the rack. Said perpendicular member includes a gas spring or variable resistance shock on each medial end. Said variable resistance shocks may act as dampeners to absorb the left and right tilting that the exerciser may employ.

Figure 32A:
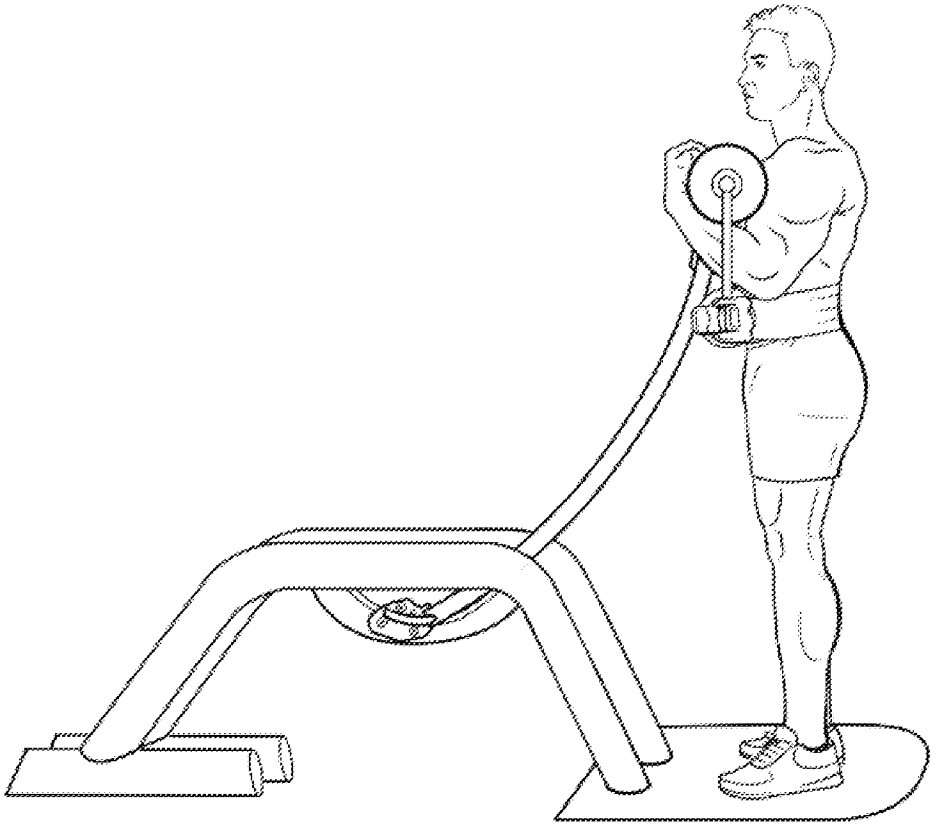
FIG. 32A and FIG. 32B are side perspective views of a squatting machine employing the compressive and protective brace.
Figure 32B:
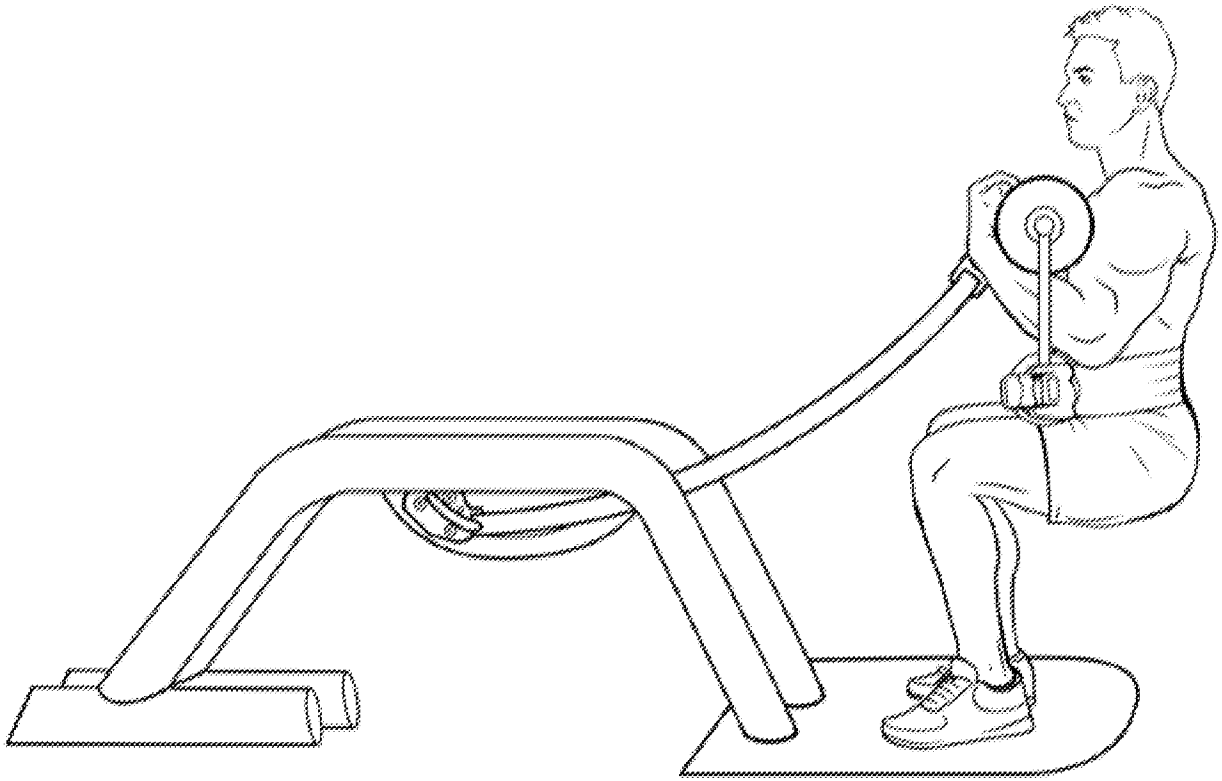

FIG. 32A and FIG. 32B are a side perspective views of a squatting machine employing the compressive and protective brace. The brace comprises a rigid anterior side and a flexible posterior side. In some embodiments, the anterior side of the brace is attached to a lever of the squatting machine. In some embodiments, the lever resembles the curved rail and trolley as shown in FIG. 17.

Figure 33:
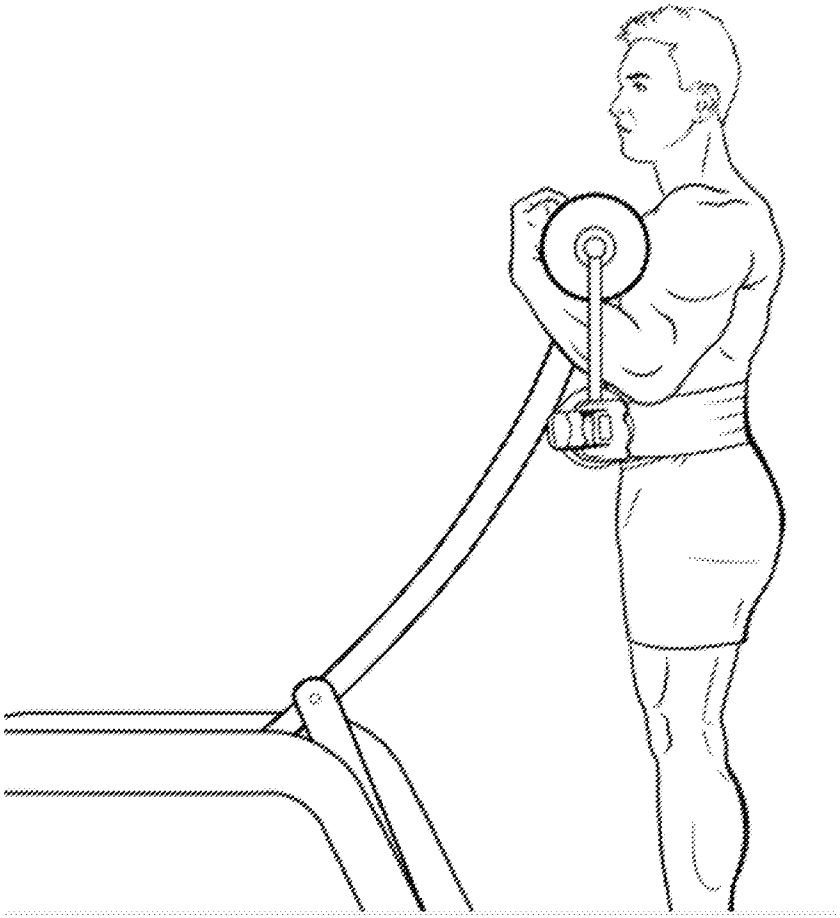
FIG. 33 is a magnified view of a side perspective view of a squatting machine as shown in FIG. 32A and FIG. 32B.

FIG. 33 is a magnified view of a side perspective view of a squatting machine employing the compressive and protective brace as shown in FIG. 32A and FIG. 32B.

Figure 34:
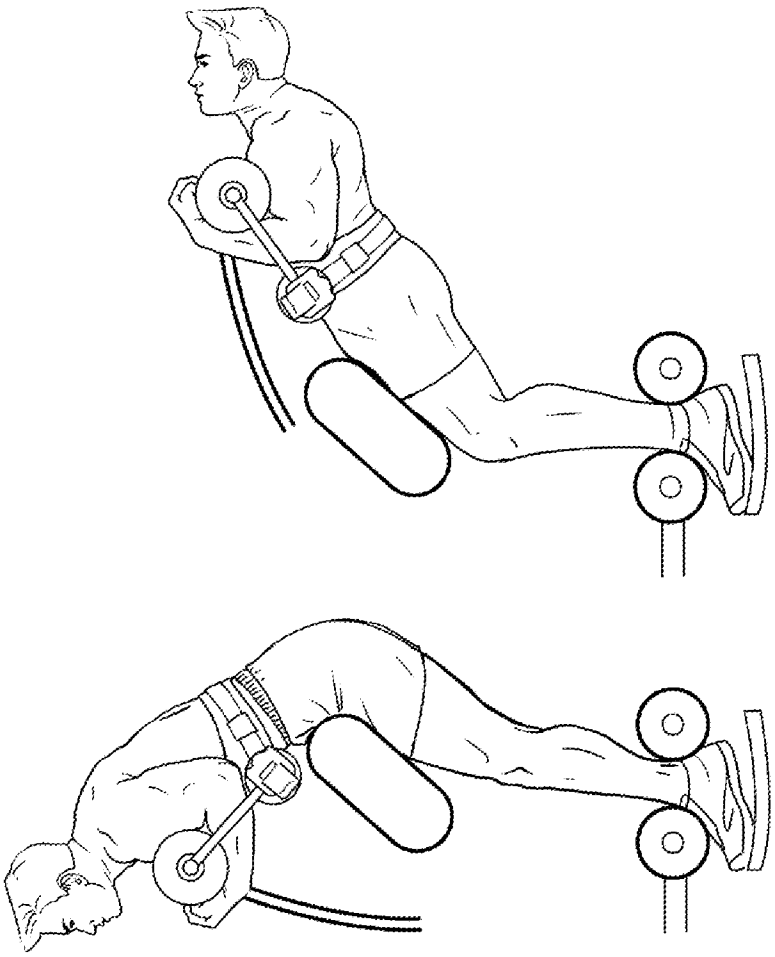
FIG. 34 is a side perspective view of a back extension machine employing the compressive and protective brace.

FIG. 34 is a side perspective view of a glute hamstring back extension machine employing the compressive and protective brace. The brace comprises a rigid anterior side and a flexible posterior side. In some embodiments, the anterior side of the brace is attached to a lever of the back extension machine. In some embodiments, the lever resembles the curved rail and trolley as shown in FIG. 17.

Figure 35A:
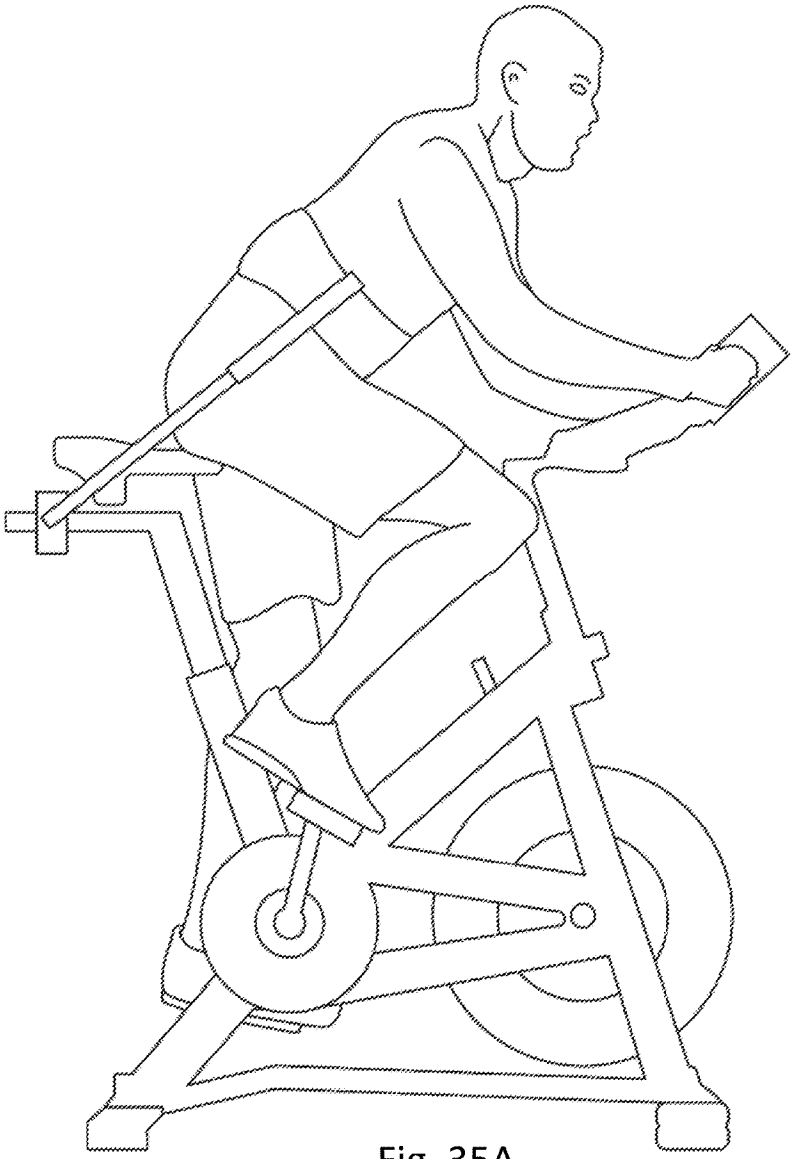
FIG. 35A and FIG. 35B is a side perspective view of a stationary bike machine employing the compressive and protective brace.
Figure 35B:
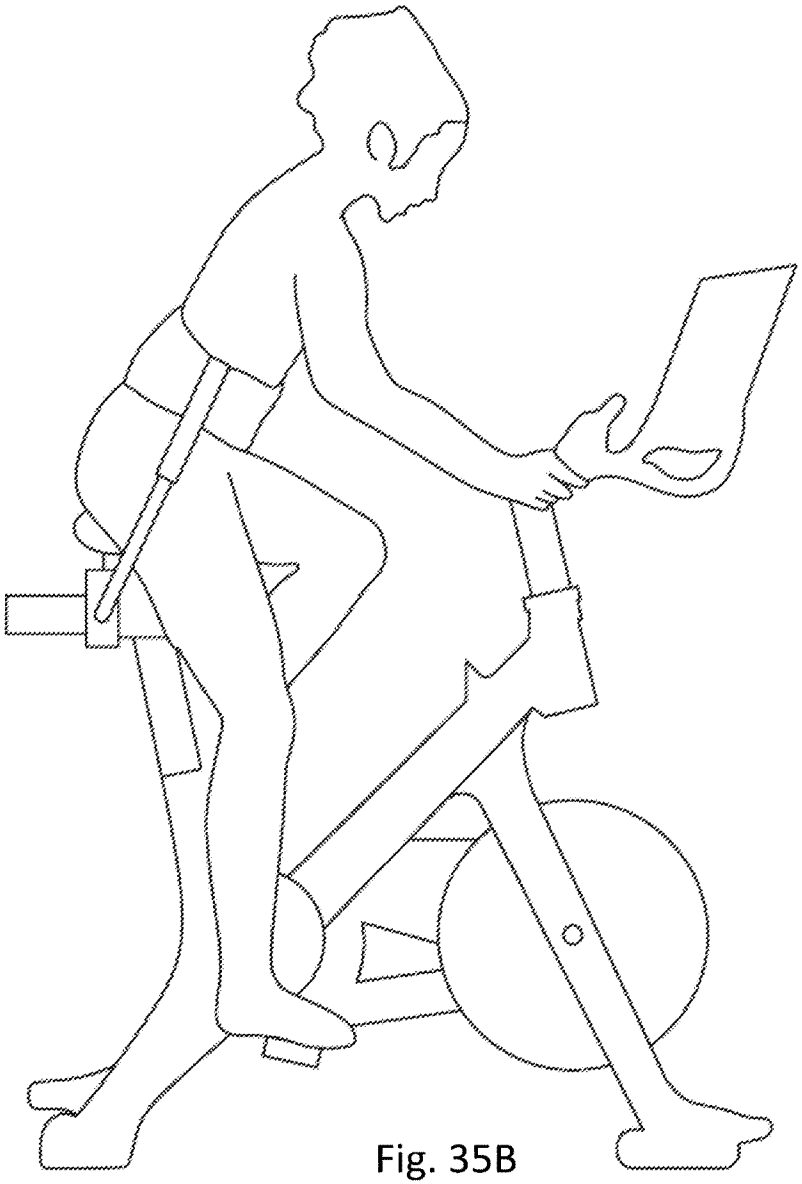

FIG. 35A and FIG. 35B is a side perspective view of a stationary bike machine employing the compressive and protective brace. The brace comprises a flexible anterior side and a rigid posterior side. The U-shaped support member attaches to the brace and the seat of the bicycle.

Figure 36:
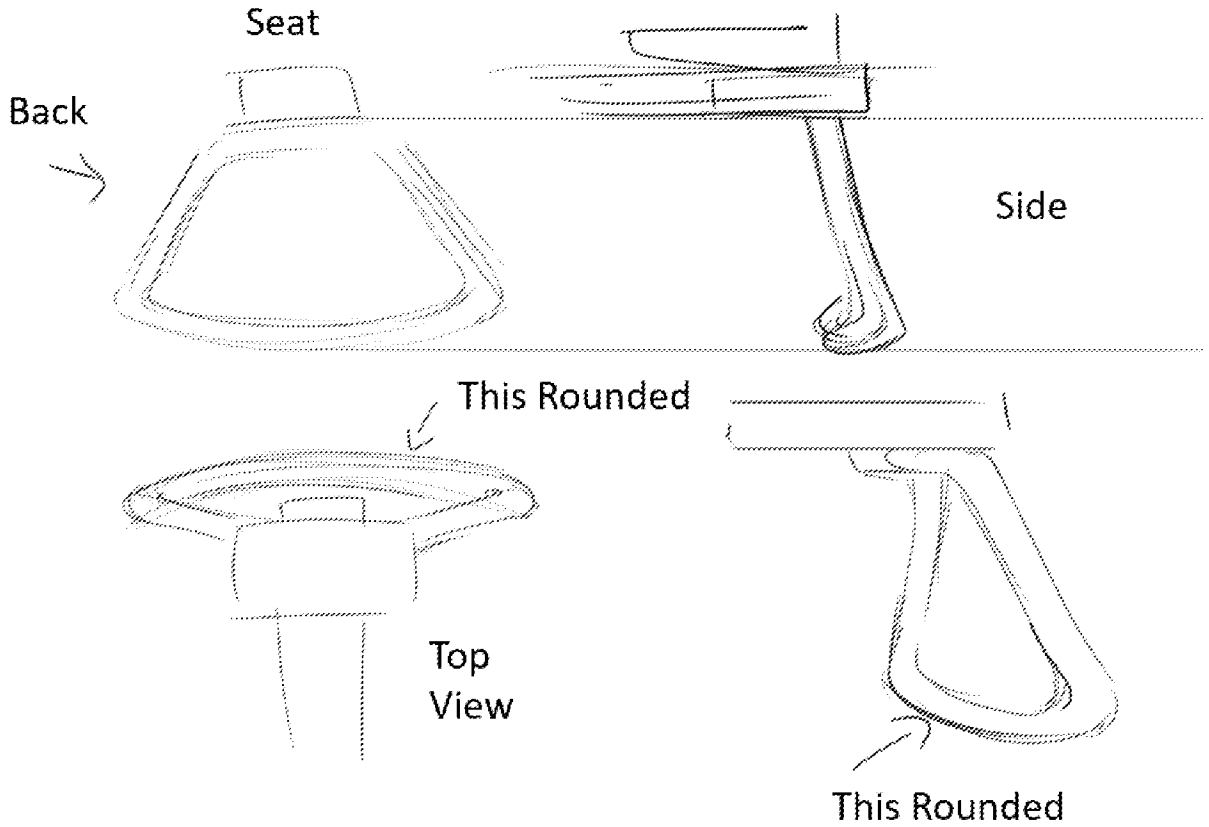
FIG. 36 is a detailed view of a seat and seatback.

FIG. 36 is a detailed view of a posterior end (e.g., solid metal foot on the floor) with the rocking element (e.g., concave rocker) of FIG. 30A or FIG. 30B.

Figure 37:
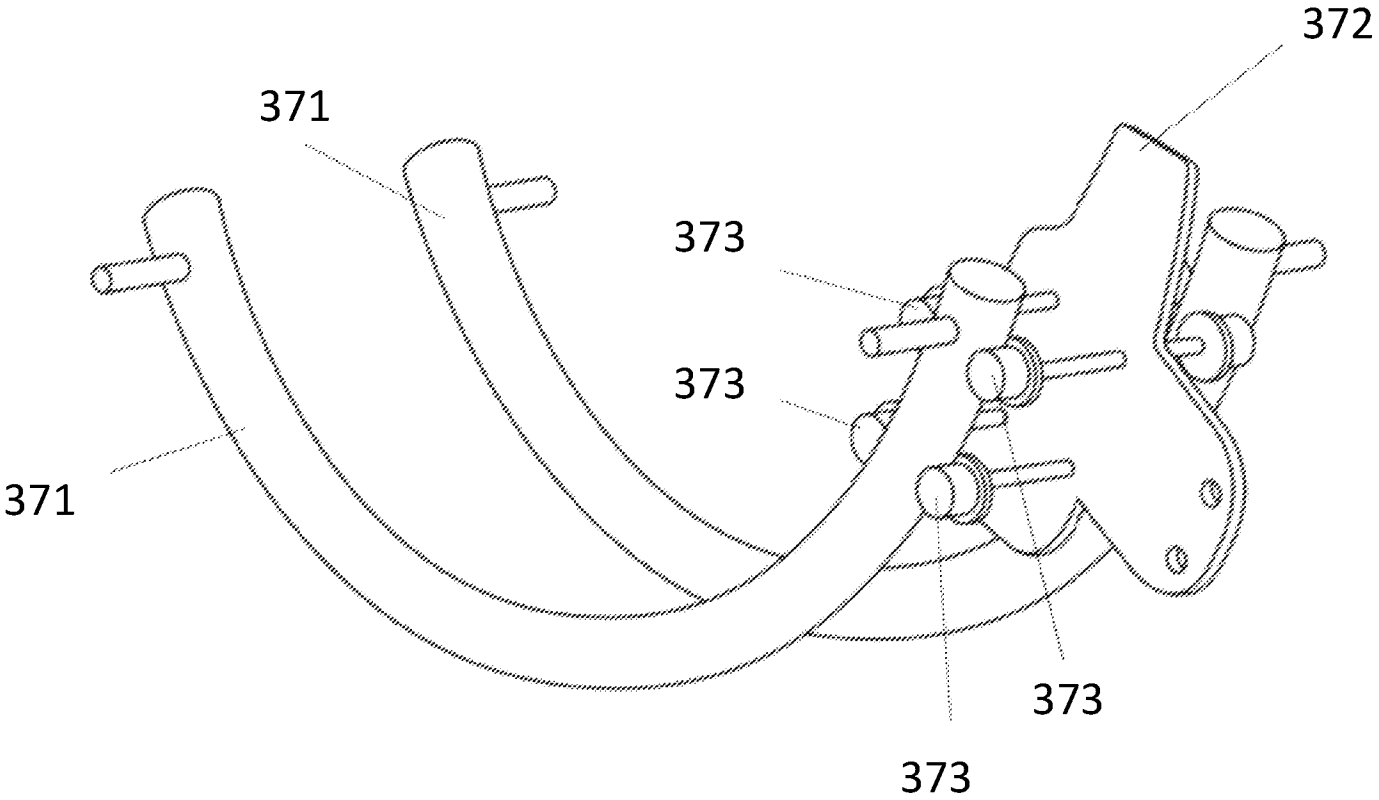
FIG. 37 is a detailed view of the curved rail as shown in FIG. 17B and FIG. 17C.

FIG. 37 is a detailed view of the curved rail as shown in FIG. 17B and FIG. 17C. The plate, which acts as the base structure for the guide arm 372 comprises eight bearings 373 and is slidable along the curved rail 371.

Figure 38:
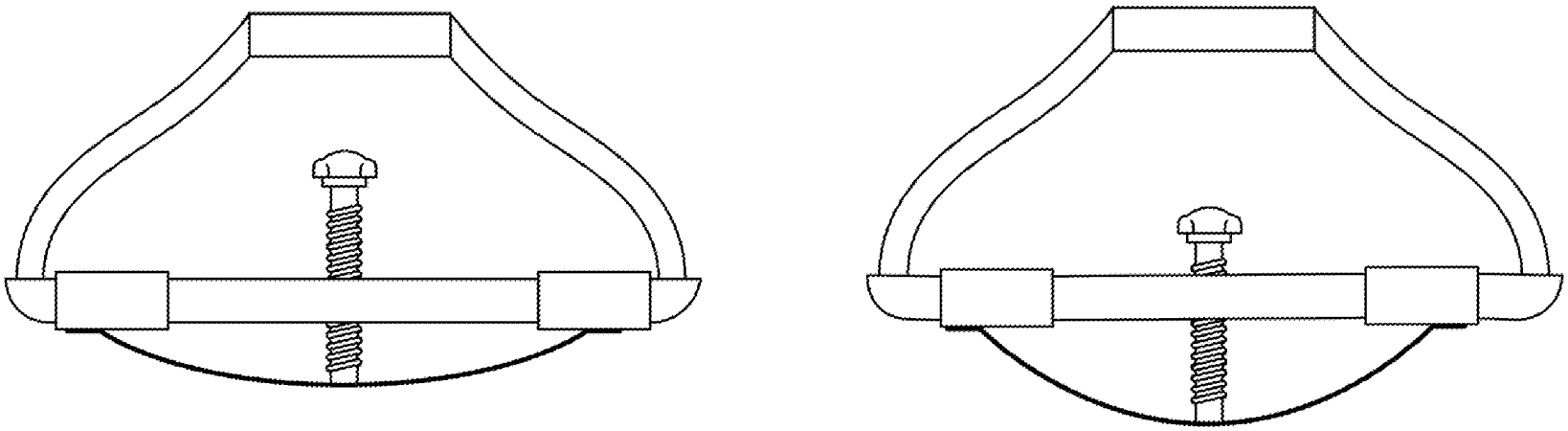
FIG. 38 is a detailed view of the base bar comprising a screw and screw hole as shown in FIG. 30B.

FIG. 38 is a detailed view of the base bar comprising a screw and screw hole as shown in FIG. 30B.

Figure 39:
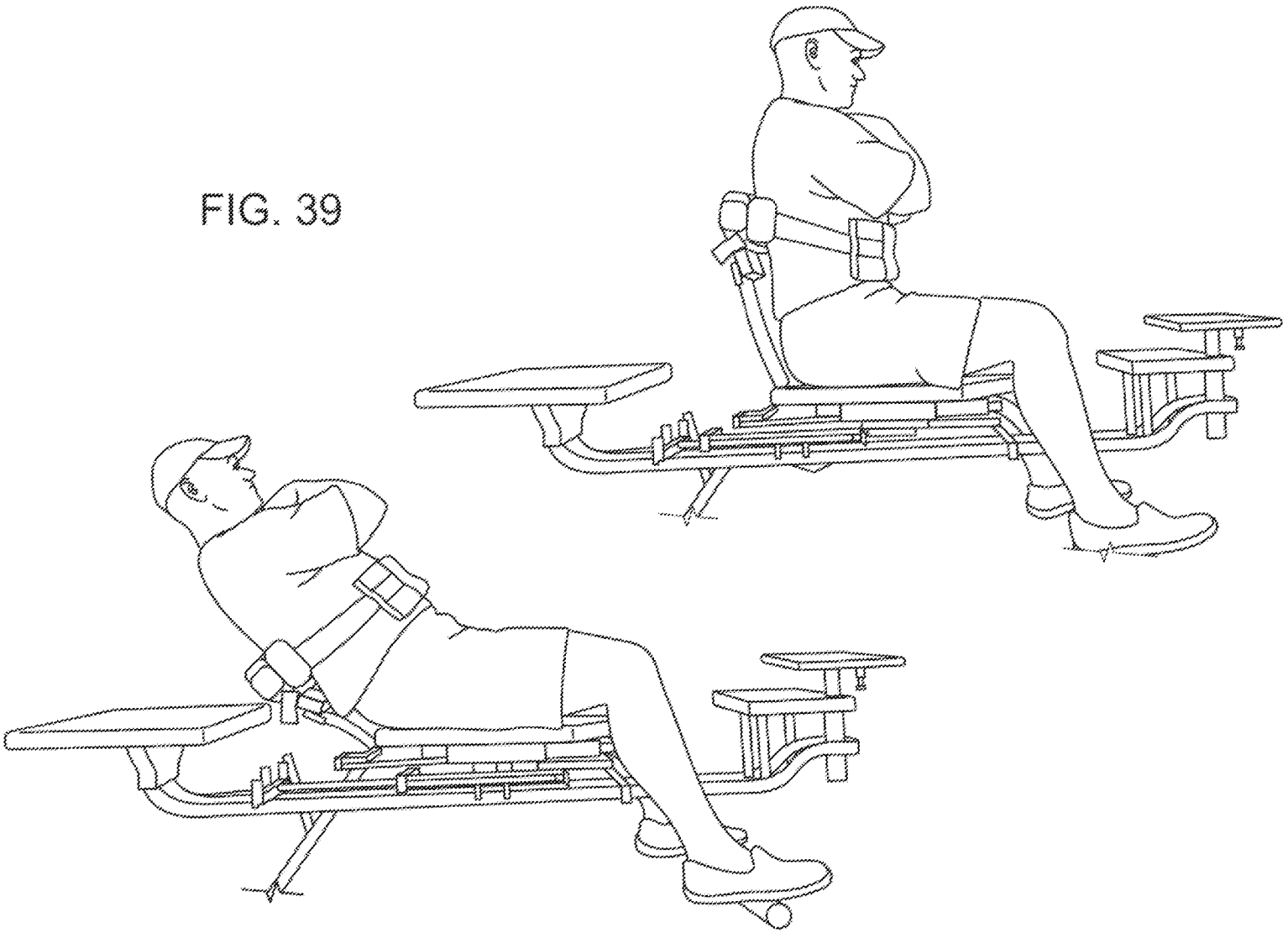
FIG. 39 is a side perspective view of a sit up machine employing the compressive and protective brace.

FIG. 39 is a side perspective view of a sit up machine employing the compressive and protective brace.

Additional variants of the exemplary embodiment set forth above may be arrived at as follows.

In some embodiments, free weights may be attached to the brace for added weight during exercise. For example, the free weights attached to the brace may resemble a weight vest.

A variety of fasteners can be used to affix the anterior side and the posterior side of the brace. In some embodiments, the fasteners comprise screws. In other embodiments, the fasteners comprise a nut and bolt, or chemical fastening (e.g., adhesives).

In some embodiments, flexible material or solid, inflexible material is used in the posterior side of the brace. In some embodiments, solid, inflexible material or flexible material is used in the anterior side of the brace. In some embodiments, flexible material is used in the anterior side of the brace and solid, inflexible material is used in the posterior side of the brace.

In some embodiments, the brace may comprise a stimulus feature in the anterior side, posterior side, or both sides of the brace. The stimulus feature may be selectively controlled to provide an electronically controlled stimulus signal for stimulating the area of the abdomen or back or both under the brace. Exemplary stimulus features include, but are not limited to, Transcutaneous Electrical Nerve Stimulation (TENS), heat stimulation, massage stimulation, or any combination thereof In some embodiments, the stimulus feature may lead to bio feedback by the exerciser.

In some embodiments, various cinching and clasping assemblies are provided for the anterior and or posterior portions of the brace, including ratchets, hook-and-pile or hook-and-loop, seat belt style connectors, or strap-in binding (e.g., snow board binding) strap style connectors.

In some embodiments, the brace may comprise air bladder. The air bladder may be located at the anterior side, posterior side, or both anterior and posterior sides of the brace. The air bladder allows for compression to occur in specific zones of the abdomen during rowing. In some embodiments, the air bladder extends from the lower abdomen to the inguinal canal of the exerciser. It will be appreciated that the air bladder will aid weak lower abdominal muscles during exercise activity. In some embodiments, the air bladder may be the only element to induce compression on the area of the abdomen below the umbilicus. In some embodiments, the air bladder may be used to prevent or aid in the treatment of a hernia. In some embodiments air may flow in and out of the air bladder in between phases and may be actuated by the pulling and recovery. The air bladder fills as the exerciser performs the drive. The air is released during the recovery phase.

In addition to the specific embodiments described above, the disclosed subject matter is also directed to other embodiments having any other possible combination of the features disclosed above. As such, the particular features disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the exemplary embodiments disclosed herein.

INCORPORATION BY REFERENCE

All publications patent applications mentioned herein are hereby incorporated by reference in their entirety as if each individual publication or patent application was specifically and individually indicated to be incorporated by reference. In case of conflict, the present application, including any definitions herein, will control.

Equivalents

Those skilled in the art will recognize, or be able to ascertain using no more than routine experimentation, many equivalents to the specific embodiments of the invention described herein. Such equivalents are intended to be encompassed by the following claims.

The invention claimed is:

1. An exercise machine comprising:

a rail having a first end and a second end;

a seat slidably attached to the rail;

a joint disposed at the first end of the rail, the joint connecting the first end of the rail to a stationary machine body having a resistive element for providing resistance to a user, the joint permitting rotational motion of the rail relative to the stationary machine body;

a rocking member disposed at the second end of the rail, the rocking member configured to rock on a supporting surface during the rotational motion of the rail.

2. The exercise machine of claim 1, further comprising a support member, the support member comprising:

an upright portion, an inferior attachment site, the inferior attachment site connecting from the upright portion to a seat slidably attached to a rowing machine rail, a superior attachment site, the superior attachment site connecting from the upright portion to a brace and configured to be received in the brace.

3. The exercise machine of claim 2, wherein the rowing machine rail is affixed to a wedge.

4. The exercise machine of claim 2, wherein the brace disposed perpendicular to the upright portion of the support member and attached to the superior attachment site, the brace comprising:

an anterior side, the anterior side having a curvature configured to contact an exerciser's abdomen perpendicular to a spinal column of the exerciser and attaching to the superior attachment site of the support member, and a posterior side, the posterior side having a curvature configured to contact an exerciser's back perpendicular to the spinal column of the exerciser and attaching to the superior attachment site of the support member, wherein the posterior side is releasably attachable to the anterior side by an attachment mechanism.

5. The exercise machine of claim 4, wherein the posterior side of the brace comprises a seat back.

6. The exercise machine of claim 4, wherein the posterior side of the brace comprises a roller.

7. The exercise machine of claim 4, wherein the attachment mechanism comprises a ratchet.

8. The exercise machine of claim 4, wherein the anterior side of the brace further comprises an air bladder.

9. The exercise machine of claim 8, wherein the air bladder compresses on the exerciser's abdomen during exercise.

10. The exercise machine of claim 4, wherein the brace is detachable from the support member.

11. The exercise machine of claim 4, wherein the brace is size adjustable.

12. The exercise machine of claim 4, wherein the brace is adjustable.

13. The exercise machine of claim 4, wherein the brace comprises a stimulation component.

14. The exercise machine of claim 2, further comprising a superior structure.

15. The exercise machine of claim 14, wherein the superior structure is affixed perpendicular to the upright portion of the support member.

16. The exercise machine of claim 14, wherein the superior structure is affixed to the upright portion of the support member by a downwardly extending shock absorber on a medial end of the superior structure.

17. The exerciser support device of claim 16, wherein the shock absorber expands telescopically.

18. The exercise machine of claim 1, wherein the rocking member tilts perpendicular to the upright portion of the support member between 20 degrees to 160 degrees.

19. The exercise machine of claim 1, wherein the rocking member comprises a ball joint.

20. The exercise machine of claim 1, wherein the rocking member comprises a hinge joint.

* * * * *